US008123334B2

(12) United States Patent
Yokouchi et al.

(10) Patent No.: US 8,123,334 B2
(45) Date of Patent: Feb. 28, 2012

(54) LIQUID EJECTION HEAD AND IMAGE FORMING APPARATUS

(75) Inventors: Tsutomu Yokouchi, Ashigarakami-gun (JP); Yoshimitsu Arai, Ashigarakami-gun (JP)

(73) Assignee: Fujifilm Corporation, Tokyo (JP)

( * ) Notice: Subject to any disclaimer, the term of this patent is extended or adjusted under 35 U.S.C. 154(b) by 346 days.

(21) Appl. No.: 12/560,478

(22) Filed: Sep. 16, 2009

(65) Prior Publication Data

US 2010/0066787 A1 Mar. 18, 2010

(30) Foreign Application Priority Data

Sep. 16, 2008 (JP) ..... 2008-236927

(51) Int. Cl.
*B41J 2/16* (2006.01)

(52) U.S. Cl. ..... 347/47

(58) Field of Classification Search ..... 347/47, 347/40, 42, 44, 49, 54, 56, 61, 65, 30, 28, 347/29
See application file for complete search history.

(56) References Cited

U.S. PATENT DOCUMENTS 5,719,603 A * 2/1998 Nguyen ..... 347/28
7,364,267 B2 * 4/2008 Sasaki ..... 347/47
2005/0024431 A1 * 2/2005 Miura et al. ..... 347/47
2007/0229611 A1 10/2007 Nagashima
2008/0284814 A1 * 11/2008 Chikamoto et al. ..... 347/29

FOREIGN PATENT DOCUMENTS

JP 2006-62166 A 3/2006
JP 2007-261204 A 10/2007

OTHER PUBLICATIONS

Robert F. Fedors, "A Method for Estimating Both the Solubility Parameters and Molar Volumes of Liquids," Polymer Engineering and Science, Feb. 1974, pp. 147-154, vol. 14, No. 2.

* cited by examiner

*Primary Examiner* — Kristal Feggins
(74) *Attorney, Agent, or Firm* — Sughrue Mion, PLLC

(57) ABSTRACT

A liquid ejection head has: a nozzle plate having a nozzle surface in which at least one nozzle for ejecting droplets of a liquid are formed; an anti-drying liquid supply port which supplies an anti-drying liquid to the nozzle surface of the nozzle plate; a flow channel portion which is formed in the nozzle surface and through which the anti-drying liquid supplied to the nozzle surface from the anti-drying liquid supply port flows; and an anti-drying liquid discharge port which suctions and discharges the anti-drying liquid flowing through the flow channel portion on the nozzle surface, from the nozzle surface, wherein, while the anti-drying liquid flows through the flow channel portion, the anti-drying liquid evaporates to increase humidity.

17 Claims, 23 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly to a head structure that can be used desirably for preventing drying of ink in a nozzle of an inkjet head and an image forming apparatus having such a head structure.

2. Description of the Related Art

Japanese patent application publication No. 2006-62166 discloses a so-called on-demand type of inkjet recording apparatus. In order to prevent the deterioration of recording qualities caused by increase in the viscosity of ink in nozzles in cases where the ink is not ejected over a long time, this inkjet recording apparatus has a humidification liquid supply port provided in the ejection surface of the recording head, and a moistening region in which the moistening liquid oozing from the humidification liquid supply port is evaporated. In this apparatus, the ejection surface is moistened by evaporation of the moistening liquid in the moistening region.

Japanese patent application publication No. 2007-261204 discloses a liquid ejection head comprising: an air flow supply port which is located near a nozzle and supplies air flow containing moisture of a volatile solvent of ink; and an air flow circulation mechanism which circulates recovered air flow and supplies it again from the air flow supply port.

In the inkjet recording apparatus disclosed in Japanese patent application publication No. 2006-62166, the moistening liquid is supplied to the nozzle surface and evaporation of the moistening liquid produces moistening, but the liquid merely stays in the nozzle surface and does not circulate. Therefore, paper powder, ink mist, and the like gradually accumulate in the moistening region, deteriorating the humidification performance. Further, in cases where a mixed liquid is used for the moistening liquid, a highly-volatile component first evaporates, then the composition of the moistening liquid gradually changes, and therefore, it is difficult to offer stable moistening.

In the liquid ejection head disclosed in Japanese patent application publication No. 2007-261204, the ink ejection direction is changed due to the air flow containing the gaseous volatile liquid, reducing the accuracy of droplet landing.

SUMMARY OF THE INVENTION

The present invention has been contrived in view of these circumstances, an object thereof being to provide a liquid ejection head that can achieve stable humidification so that the drying/blocking of a nozzle can be prevented, and an image forming apparatus comprising such a liquid ejection head.

In order to attain an object described above, one aspect of the present invention is directed to a liquid ejection head comprising: a nozzle plate having a nozzle surface in which at least one nozzle for ejecting droplets of a liquid are formed; an anti-drying liquid supply port which supplies an anti-drying liquid to the nozzle surface of the nozzle plate; a flow channel portion which is formed in the nozzle surface and through which the anti-drying liquid supplied to the nozzle surface from the anti-drying liquid supply port flows; and an anti-drying liquid discharge port which suctions and discharges the anti-drying liquid flowing through the flow channel portion on the nozzle surface, from the nozzle surface, wherein, while the anti-drying liquid flows through the flow channel portion, the anti-drying liquid evaporates to increase humidity.

According to this aspect of the invention, the surroundings of the nozzle are humidified because the anti-drying liquid flowing on the nozzle surface evaporates. By suctioning the anti-drying liquid via the anti-drying liquid discharge port while supplying the anti-drying liquid to the nozzle surface from the anti-drying liquid supply port, it is possible to move the anti-drying liquid on the nozzle surface, which can always supply and circulate a fresh anti-drying liquid and thereby realize the stable humidification.

Another aspect of the present invention is directed to an image forming apparatus comprising the liquid ejection head.

According to the present invention, stable humidification can be achieved, and drying of liquid in a nozzle can be prevented. Further, even when foreign matter such as paper powder is mixed into the anti-drying liquid flowing on the nozzle surface, the anti-drying liquid can flows without staying, and therefore beneficial effects of the humidification can be fully exerted and the nozzle surface can be kept clean.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
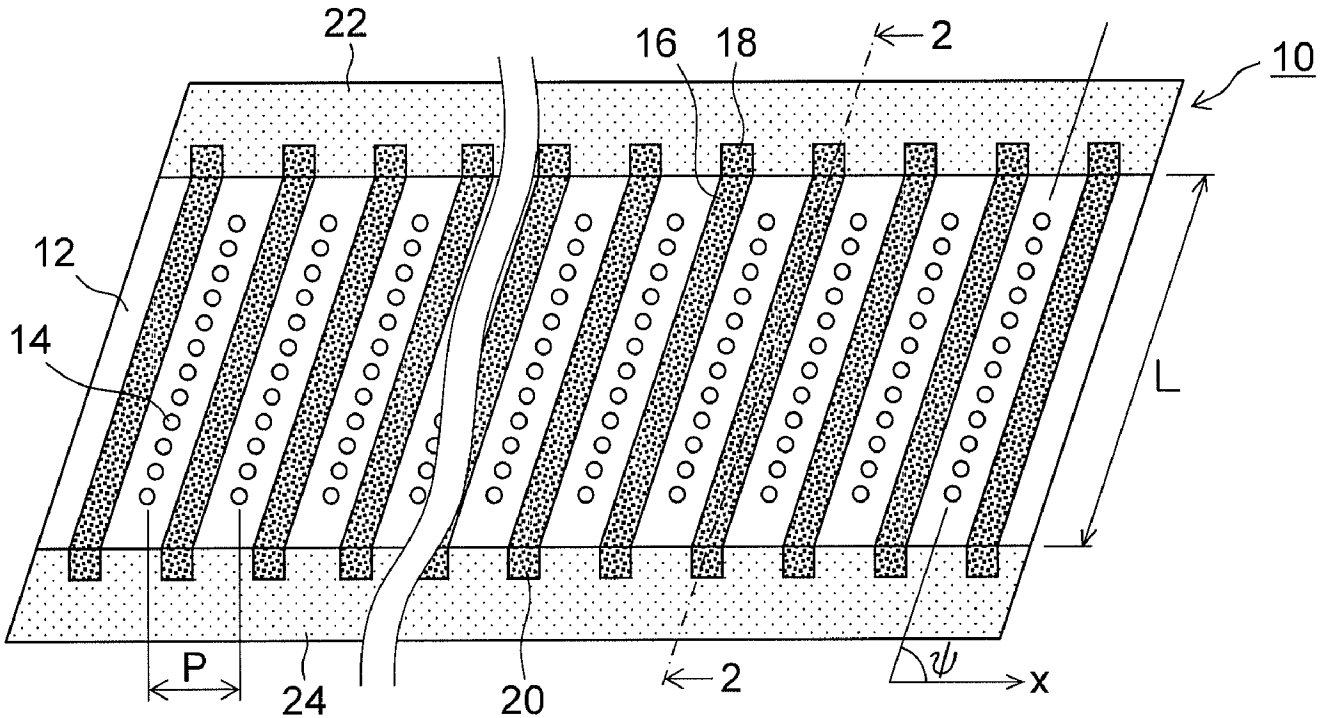
FIG. 1 is a plan diagram illustrating a head module included in an inkjet head according to a first embodiment of the invention, viewed from the ejection surface side of a nozzle plate.

FIG. 1 is a plan diagram of a head module 10 which is included in an inkjet head relating to a first embodiment of the present invention, as viewed from the ejection surface (nozzle surface) side of the nozzle plate 12. In FIG. 1, reference numeral 14 represents a nozzle which forms an ink ejection port and reference numeral 16 represents a lyophilic portion (which corresponds to a "flow channel portion") through which anti-drying liquid flows. As illustrated in FIG. 1, a plurality of nozzles 14 are formed in the nozzle plate 12 and a so-called matrix type nozzle arrangement is adopted in which a plurality of nozzle rows are formed at a uniform interval (period) P in the x direction, each nozzle row having nozzle orifices 14 arranged on an oblique straight line which intersects at an angle of $\phi$ with the lengthwise direction of the head module 10 (the x direction: the main scanning direction in a line head).

On this nozzle surface, lyophilic portions 16 to create flow channels for the flow of anti-drying liquid are formed about the periphery of the nozzle rows (both the left and right-hand sides in FIG. 1). A lyophobic film is formed on the portion of the nozzle surface other than the lyophilic portions 16. The lyophilic portions 16 illustrated in FIG. 1 are formed in a belt shape following a straight line parallel to the nozzle rows, but the form of the lyophilic portions is not limited to this and may also be a meandering shape.

Furthermore, supply ports 18 for supplying anti-drying liquid to the respective lyophilic portions 16 (hereinafter, this port may be called "anti-drying liquid supply port" according to requirements) and discharge ports 20 for discharging anti-drying liquid from the lyophilic portions 16 (hereinafter, this may be called "anti-drying liquid discharge port" according to requirements) are provided in the head module 10. The anti-drying liquid supply ports 18 open in contact with one end portions of the lyophilic portions 16, and the anti-drying liquid discharge ports 20 open in contact with the other end portions of the lyophilic portions 16. Reference numeral 22 denotes a supply channel forming member for forming a supply channel for anti-drying liquid inside the head module 10 and reference numeral 24 denotes a discharge channel forming member for forming a discharge channel for anti-drying liquid.

Figure 7:
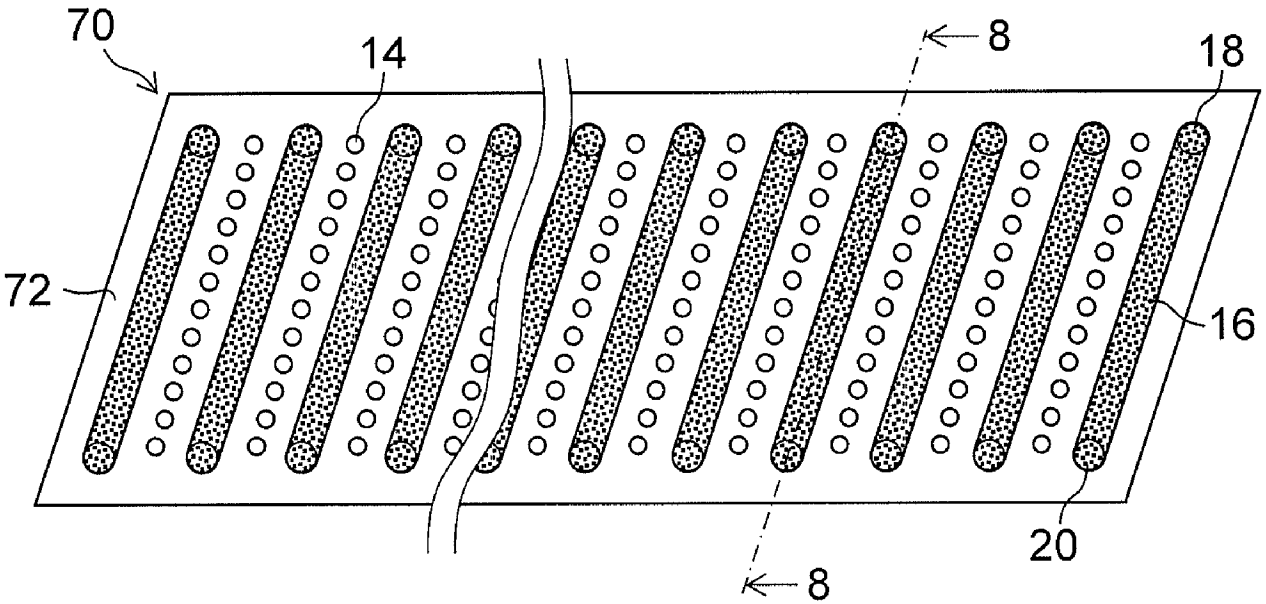
FIG. 7 is a plan diagram illustrating a head module according to another embodiment of the invention, viewed from the ejection surface side of the nozzle plate.

In the present example, as illustrated in FIG. 1, anti-drying liquid supply and discharge channels are formed in a high-density head by means of a composition comprising the supply channel forming member 22 and a discharge channel forming member 24 in the periphery of the nozzle plate 12 (above and below same in FIG. 1), but it is also possible to adopt a mode in which an anti-drying liquid supply port 18 and discharge port 20 are provided in the nozzle plate 12 (being formed so as to pass through the nozzle plate 12) (described below in relation to FIG. 7).

Figure 2:
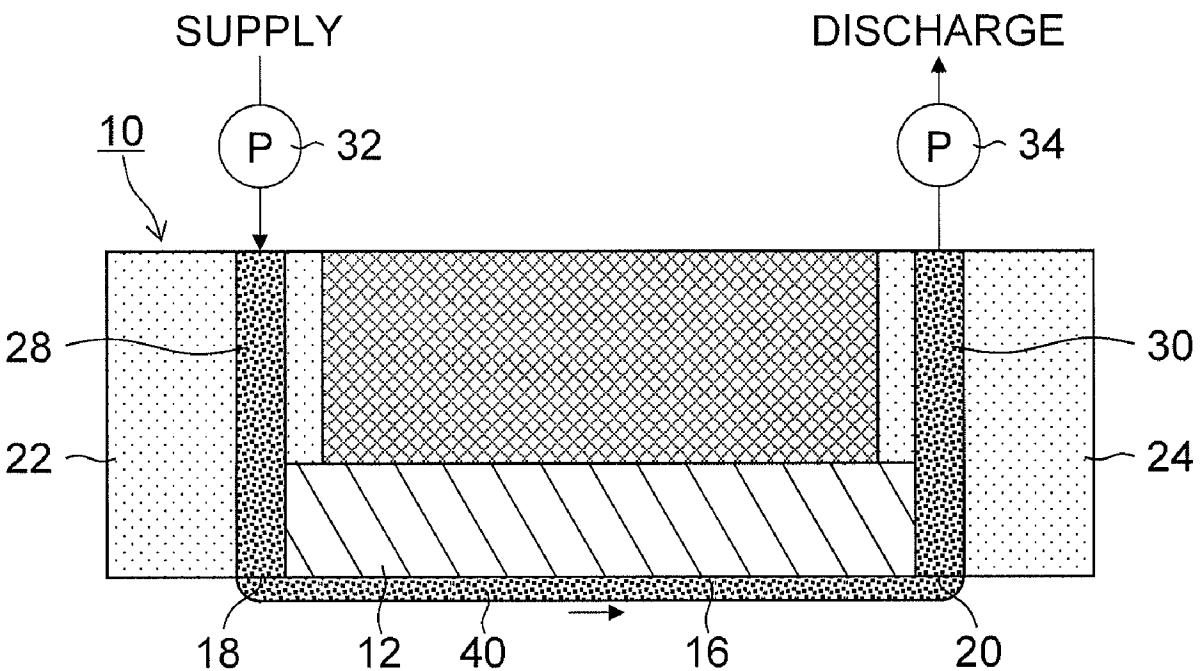
FIG. 2 is a cross-sectional diagram along line 2-2 in FIG. 1.

FIG. 2 is a cross-sectional diagram along line 2-2 in FIG. 1. Incidentally, FIG. 2 illustrates anti-drying liquid supply and discharge channels, but does not depict the ink supply channels, and the like, inside the head on the rear surface side of the nozzle plate 12. A pressurization pump 32 for liquid supply (sending liquid) is connected to the anti-drying liquid supply channel 28 and a suction pump 34 for suctioning and discharging is connected to the discharge channel 30.

The pressure pump 32 is operated and anti-drying liquid 40 is caused to seep out from a supply port 18 (the liquid wets and spreads without dropping off from a supply port 18). The anti-drying liquid 40 wets and spreads along the lyophilic portions 16 due to the wetting properties of the lyophilic portions 16 in the nozzle plate 12, and eventually arrives at the discharge ports 20. By driving the suction pump 34 and suctioning the anti-drying liquid 40 from each discharge port 20, it is possible to promote the flow of anti-drying liquid 40 into the lyophilic portions 16 between the supply ports 18 and the discharge ports 20, and it is possible thereby to circulate the anti-drying liquid 40.

It is also possible to adopt a composition which omits the pressure pump 32 for supplying liquid, and it is possible to create a flow of anti-drying liquid in the nozzle surface by means of the suction pump 34 only.

Figure 3A:
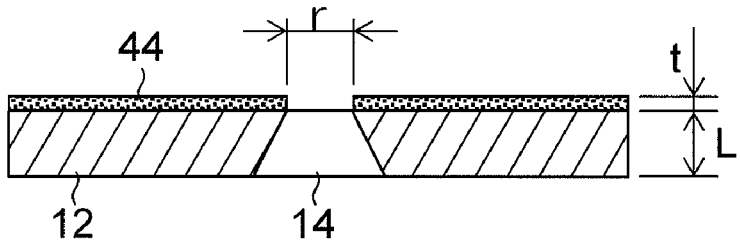
FIGS. 3A to 3C are explanatory diagrams illustrating one example of a method of forming lyophilic portions for an anti-drying liquid flowing.
Figure 3B:
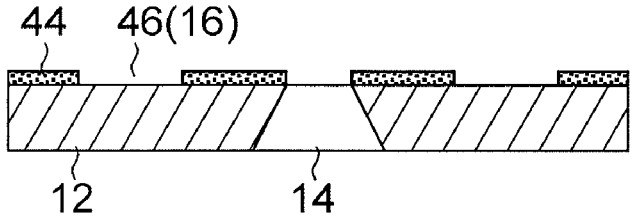
Figure 3C:
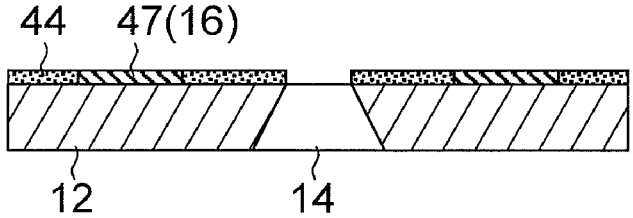

FIGS. 3A to 3C are illustrative diagrams illustrating a manufacturing process for forming lyophilic portions on the nozzle surface of a nozzle plate.

Step 1: Step of Forming Nozzles and Lyophobic Film

Firstly, as illustrated in FIG. 3A, a lyophobic film 44 is formed on the ejection side surface of a nozzle plate 12 which comprises nozzles 14. Various methods can be chosen as the concrete method of obtaining the nozzle plate 12 having nozzles 14 and the lyophobic film 44. For example, the nozzles can be formed by etching a silicon substrate, whereupon a lyophobic film 44 is formed by coating (application) or vapor deposition. As a further method, it is also possible to adopt a mode in which a nozzle plate 12 having nozzles 14 is manufactured by electroforming, and a lyophobic film 44 is formed on this plate by coating (application) or eutectic (eutectoid) plating. Since various other methods can also be chosen, the appropriate method should be employed in view of the required accuracy, costs and other factors.

As an example of the specific dimensions of the nozzle plate 12 used in the inkjet recording apparatus, the nozzle diameter r is 10 to 50 μm, the nozzle length L is 10 to 100 μm, the thickness t of the lyophobic film (created by a film deposition method) is several nm to 5 μm, and the nozzle row pitch (see FIG. 1) is 100 to 1000 μm.

Step 2: Step of Removing a Portion of the Lyophobic Film at the Periphery of the Nozzles in Order to Improve Wetting Properties in that Portion Next, as illustrated in FIG. 3B, portions of the lyophobic film 44 about the periphery of each nozzle 12 (the portions which are to be lyophilic portions via a later stage) are removed. This removed portions 46 (lyophilic portions 16) have better wetting properties than the portions where the lyophobic film 44 is still present.

Figure 4:
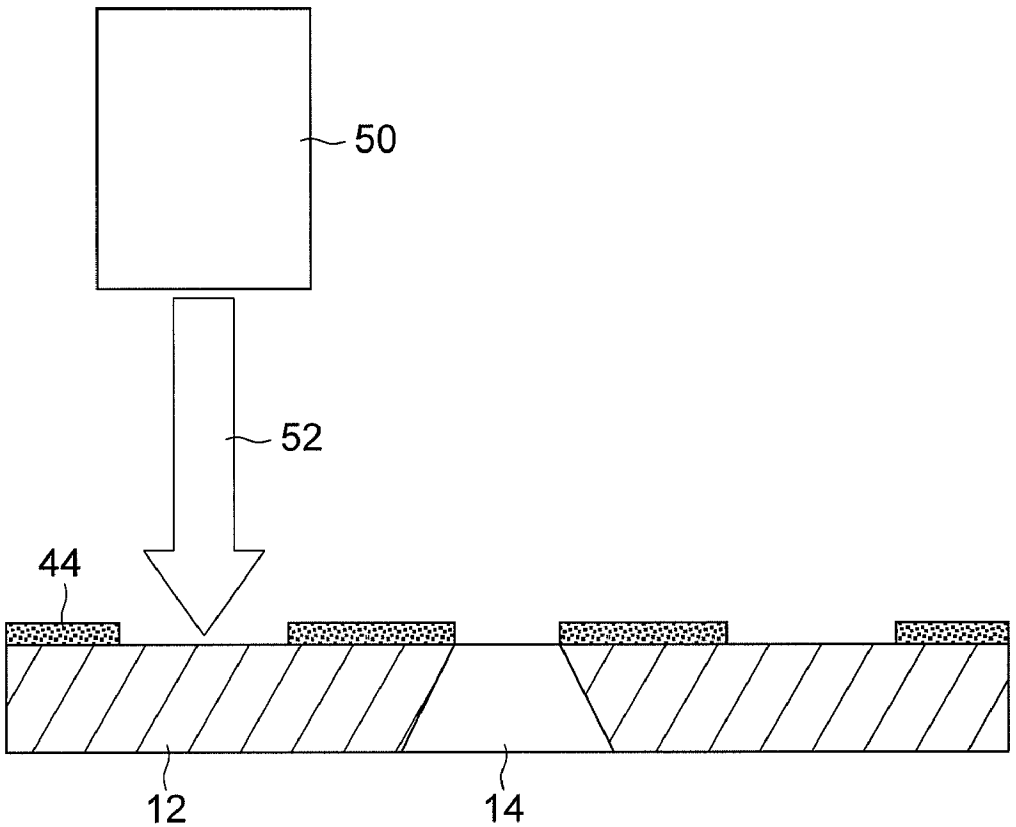
FIG. 4 is an illustrative diagram illustrating a method of removing a lyophobic film by laser.
Figure 5:
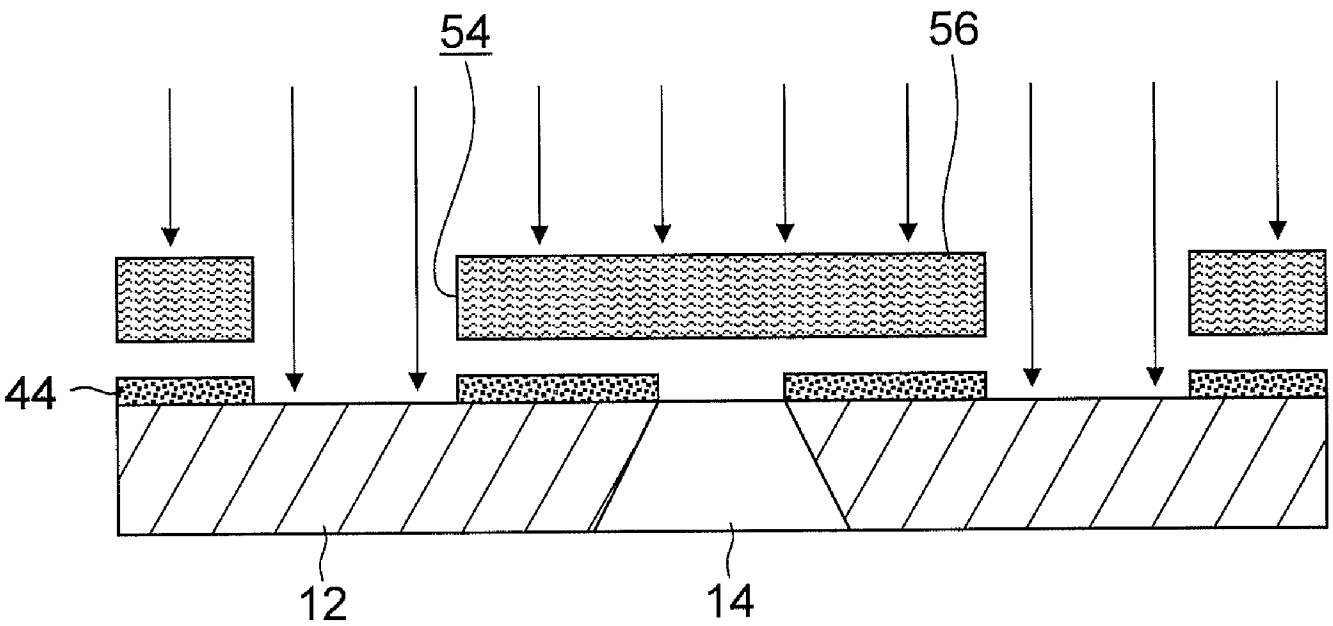
FIG. 5 is an illustrative diagram of a step of removing a lyophobic film by means of ultraviolet light or oxygen plasma.

As a method of removing a portion of the lyophobic film 44, for example, there is a mode in which the film is removed with laser light (see FIG. 4), or a mode where the area other than the portion for removal is masked, and then a portion of the film is removed by plasma processing (using an oxygen plasma, or the like), or by irradiation of ultraviolet light (FIG. 5).

As illustrated in FIG. 4, by irradiating laser light 52 from a laser processing head 50 onto portions of the nozzle plate 12 where the lyophobic film 44 formed thereon is to be removed, it is possible to remove the portions of the lyophobic film 44. For the laser light source, it is possible to select one of various types of the laser light source, such as an excimer laser, a carbon dioxide ($CO_2$) laser, a YAG laser, or the like.

FIG. 5 illustrates an example of a mode of carrying out plasma processing or irradiation of ultraviolet light. As illustrated in FIG. 5, by irradiating an oxygen plasma or ultraviolet light via a mask member 56 which has openings 54 in positions corresponding to portions for removal, portions of the lyophobic film 44 which are exposed via the openings 54 are removed.

If the modes in FIG. 4 and FIG. 5 are compared, then if a portion of the film is removed by laser, a merit is obtained in that no masking member is required. On the other hand, if an oxygen plasma or ultraviolet light is used, then a mask member 56 must be fabricated and aligned with the nozzles 14, but a merit is obtained in that batch processing can be carried out over a surface. The most efficient method should be selected in view of the size of the nozzle plate, the production volume, or other factors.

Furthermore, as a method of improving the wetting properties of one portion (rendering a lyophilic characteristic to one portion) other than a mode which removes a portion of the lyophobic film 44, there is a mode in which the lyophobic film 44 is modified partially (FIG. 3C) or a method where, in locations where it is wished to apply the resin, an intermediate film (not illustrated) that enables the resin to be provided is provided.

Reference numeral 47 in FIG. 3C represents a modified portion of the lyophobic film 44. As a means of selectively modifying a portion of the lyophobic film 44, for example, it is possible to employ oxygen plasma processing using a mask member 56, similarly to FIG. 5.

Another Manufacturing Method

Concerning the method of manufacture described in FIGS. 3A to 3C, it is stated that after forming a lyophobic film 44 uniformly on the ejection surface side of the nozzle plate 12, a portion of that film is removed or modified (FIGS. 3B and 3C), but it is also possible to adopt a mode in which portions where lyophobic film is formed and portions where lyophobic film is not formed are patterned when the lyophobic film 44 is formed, rather than carrying out a staged process as described above. In other words, when forming a lyophobic film, the lyophobic film is deposited in such a manner that the lyophobic film is not present in the portions where a flow channel in which an anti-drying liquid flows is formed in a later stage.

Figure 6A:
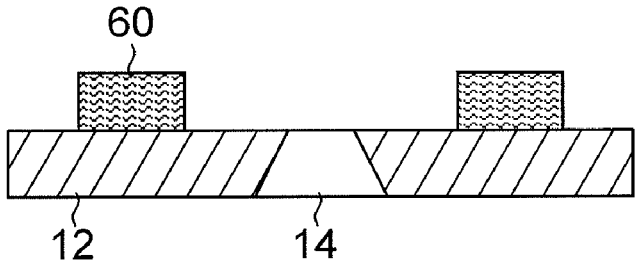
FIGS. 6A to 6C are step diagrams illustrating an example where patterning is carried out during the formation of a lyophobic film.
Figure 6B:
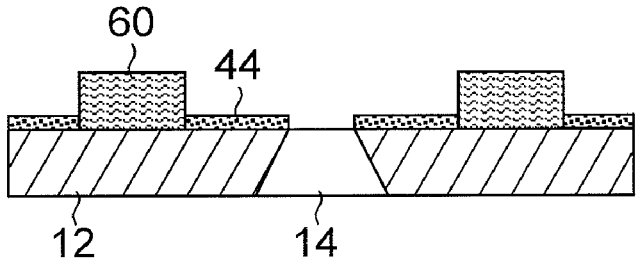
Figure 6C:
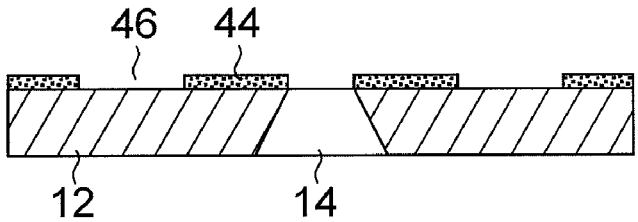

FIGS. 6A to 6C are step diagrams illustrating an example where patterning is carried out during the formation of the lyophobic film.

Firstly, as illustrated in FIG. 6A, on the ejection surface side of a nozzle plate 12 in which nozzles 14 are formed, a member (sacrifice layer) which can be removed in a later stage, such as a resist (photosensitive resin) 60, is formed onto the portions (lyophobic film removal portions) where it is wished to form lyophilic portions in a later step.

Thereupon, a lyophobic film 44 is formed by eutectic plating (eutectoid plating), vapor deposition, or the like (FIG. 6B), and the resist 60 (sacrifice layer) is then removed (FIG. 6C).

According to this method of manufacture, although the step of patterning the resist 60 is added, the step of removing the lyophobic film 44 is eliminated. Furthermore, when the lyophobic film 44 is removed subsequently, if the film is not removed satisfactorily, then there is a possibility that it becomes difficult to flow the anti-drying liquid stably, but according to the method of manufacture described in FIGS. 6A to 6C, it is possible reliably to form a portion where there is no lyophobic film. However, in order to form a lyophobic film 44 on a substrate where resist 60 has been formed (FIG. 6B), it is necessary to match the resist material with the method of forming the lyophobic film, and hence there is a possibility that methods which can be employed to form the lyophobic film can be restricted.

Anti-Drying Liquid

The anti-drying liquid is composed of a solution containing either the component having the highest composition ratio, of the ink components apart from the coloring material and the anti-drying agent, or taking this as a main component and also including other components. In other words, it is suitable to use for the anti-drying liquid, either water, which is the main component of the liquid, or an aqueous solution including components such as a permeation agent which forms part of the ink, a pH adjusting agent, an antiseptic and antibacterial agent, or the like. In particular, in the case of a pigment-based ink, it is desirable for the pH of the aqueous solution to be substantially the same as that of the ink, in order to prevent decline in dispersibility due to change in the pH of the ink at the ejection port. Moreover, in order to improve wetting with respect to the lyophilic portion, it is also possible to adjust the surface tension of the anti-drying liquid by means of a surfactant, alcohol, or the like.

The anti-drying liquid may also use the liquid used in cleaning the nozzle surface. In this case, it is possible to clean simply by wiping in a state where the anti-drying liquid is present, without especially applying cleaning liquid during wiping. The following substance is used as a combined anti-drying liquid and cleaning liquid.

Combined Anti-Drying Liquid and Cleaning Liquid

The combined anti-drying liquid and cleaning liquid has a characteristic feature in that the entire solvent contains 50 percent by mass or more of a solvent having an SP value (solubility parameter) of 27.5 or less. By containing 50 percent by mass or more of a solvent having an SP value of 27.5 or less in the entire solvent, it is possible to improve the maintenance properties.

Desirably, apart from using the solvent described above, it is also desirable to use water, but besides this there are no particular restrictions. From the viewpoint of improving the performance in removing solidified ink adhering material attached to the inkjet head, it is more desirable to include an adjusting agent which adjusts the pH or surfactant, and furthermore, it is also possible to use other additives, such as an antibacterial agent, an anti-rusting agent, an antiseptic agent, or a viscosity adjusting agent, as necessary.

Solvent Having SP Value of 27.5 or Less

The solvent having an SP value of 27.5 or less which is used in the present embodiment (hereinafter, "solvent") is contained at a ratio of 50 percent by mass or more in the entire solvent, but from the viewpoint of improving performance in removing solidified ink adhering material attached to the inkjet head, more desirably, this content ratio is 60% or above, even more desirably, 70% or above, and yet more desirably, 80% or above. If the content ratio is less than 50 percent by mass, then the performance in removing the solidified ink adhering material is insufficient. The solubility parameter value (SP value) of the solvent described in the present embodiment is a value expressed as the square root of the molecular aggregation energy. This value can be calculated by the method described in R. F. Fedors in Polymer Engineering Science, 14, p. 147 (1974), and is the value used in the present embodiment.

Desirable practical examples of compounds forming a solvent having an SP value of 27.5 or less according to the present embodiment and their corresponding SP values (indicated in brackets) are stated below, but the present invention is not limited to these.

Practical Examples

Diethylene glycol monoethyl ether (22.4);
Diethylene glycol monobutyl ether (21.5),
Triethylene glycol monobutyl ether (21.1),
Dipropylene glycol monomethyl ether (21.3),
Dipropylene glycol (27.2)

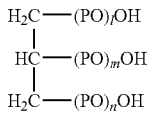

l + m + n = 3 (26.4)
PO = Polypropylene Oxide

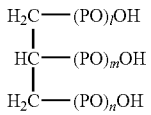

l + m + n = 4 (24.9)
PO = Polypropylene Oxide

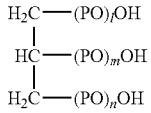

l + m + n = 5 (23.9)
PO = Polypropylene Oxide

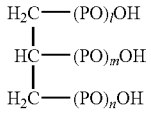

l + m + n = 6 (23.2)
PO = Polypropylene Oxide

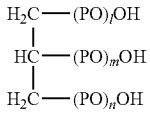

l + m + n = 7 (22.6)
PO = Polypropylene Oxide $nC_4H_9O(AO)_4$—H (AO=EO or PO, ratio—EO:PO=1:1) (20.1)
$nC_4H_9O(AO)_{10}$—H (AO=EO or PO, ratio—EO:PO=1:1) (18.8)
$HO(A'O)_{40}$—H (A'O=EO or PO, ratio—EO:PO=1:3) (18.7)
$HO(A''O)_{55}$—H (A"O=EO or PO, ratio—EO:PO=5:6) (18.8)
$HO(PO)_3$—H (24.7)
$HO(PO)_7$—H (21.2)
1,2-hexane diol (27.4)

In the present specification, EO and PO represent an ethylene oxy group and a propylene oxy group.

These may be used independently or two or more types may be used in combination.

In the present embodiment, a solvent having an SP value of 27.5 or less is contained at a ratio of 50 percent by mass or more in the whole of the solvent, but from the viewpoint of improving the solubility and swelling characteristics of the solidified ink adhering material, desirably, the solvent is one having an SP value of 24 or less, and more desirably, a solvent having an SP value of 22 or less.

Furthermore, in the present embodiment, it is possible to combine the use of other solvents, within a scope that does not impair the beneficial effects of the present embodiment.

Ink

The ink composition used in the present embodiment is a pigment-based ink composition which contains pigment. Other than the pigment, the ink contains water but apart from this, there are no particular restrictions; however, it is desirable that the ink should contain a solvent having an SP value of 27.5 or less and should contain polymer particles.

The ink composition according to the present embodiment contains at least one type of pigment. There are no particular restrictions on the pigment used in the present embodiment and it may be selected appropriately according to the objectives. For example, the pigment may be an organic pigment or an inorganic pigment.

Desirably, the ink composition according to the present embodiment contains at least one type of polymer particles. By this means, the wear resistance of the image formed is improved effectively.

Specific examples of the polymer particles in the present embodiment include: a thermoplastic, thermocurable or denaturable acrylic, epoxy, polyurethane, polyether, polyamide, unsaturated polyester, phenol, silicone or fluorine resin, a polyvinyl resin such as vinyl chloride, vinyl acetate, polyvinyl alcohol, polyvinyl butylal, or the like, a polyester resin such as an alkyd resin, phthalic acid resin, or the like, an amino material such as melamine resin, melamine formaldehyde resin, amino-alkyd co-condensated resin, urea resin, or the like, or particles of a resin having an anionic group, such as copolymers or mixtures of these. Of these, an anionic acrylic resin can be obtained, for example, by polymerising an acryl monomer having an anionic group (an anionic group-containing acryl monomer) and other monomers which can be copolymerised with the anionic group-containing acryl monomer, as necessary, in a solvent. Examples of the anionic group-containing acryl monomer include: acryl monomers having at least one or more group selected from a carboxyl group, a sulfonate group, and a phosphone group, and of these, an acryl monomer having a carboxyl group (for example, acrylic acid, methacrylic acid, crotonic acid, ethacrylic acid, propyl acrylic acid, isopropyl acrylic acid, itaconic acid, fumaric acid, or the like) is desirable, and acrylic acid or methacrylic acid are especially desirable.

As the polymer particles in the present embodiment, from the viewpoint of ejection stability and solution stability (particularly dispersion stability) when using a pigment as described hereinafter, self-dispersing polymer particles are desirable, and self-dispersing polymer particles having a carboxyl group are more desirable. Self-dispersing polymer particles are particles of a water-insoluble polymer which can be obtained in a dispersed state in an aqueous medium by means of a functional group contained in the polymer itself (in particular, an acidic group or salt thereof) in the absence of a further surfactant, and which does not contain a free emulsifier.

Desirably, the ink composition in the present embodiment contains water.

There are no particular restrictions on the added amount of water used in the present embodiment, but from the viewpoint of maintaining stability and ejection reliability, desirably, the added amount of water is 10 percent by mass or more and 99 percent by mass or less, more desirably, 30 percent by mass or more and 80 percent by mass or less, and yet more desirably, 50 percent by mass or more and 70 percent by mass or less, in the whole ink composition.

Desirably, the ink composition in the present embodiment contains a solvent.

For the solvent, it is possible to use the solvents described above for the cleaning liquid, and of these, a solvent of which 70 percent by mass or more has an SP value of 27.5 or less is desirable from the viewpoint of suppressing curl and performance in dissolving solidified adhering material originating from the ink composition, and an SP value of 26 or less is more desirable, and 24 or less is even more desirable.

For the solvent having an SP value of 27.5 or less in the present embodiment, it is possible to cite the solvents described above for the cleaning liquid, and the desirable examples are the same.

The solvent may be used independently, or two or more types of solvents may be used in a combined fashion.

There are no particular restrictions on the content ratio of the solvent in the ink composition, but from the viewpoint of maintaining stability and ejection reliability, the content ratio is desirably 1 to 60 percent by mass, more desirably, 5 to 40 percent by mass, and particularly desirably, 5 to 30 percent by mass, of the whole ink composition.

Furthermore, desirably, the solvent having an SP value of 27.5 or less is contained at a ratio of 70 percent by mass or more, and more desirably, 80 percent by mass or more, and particularly desirably, 90 percent by mass or more, or the whole solvent.

The ink composition according to the present embodiment may also include other components, as necessary, in addition to the valuable components described above. The other components may be, commonly known additives, for example, a surfactant, an ultraviolet light absorber, an anti-fading agent, an antibacterial agent, a pH adjuster, an anti-rusting agent, an antioxidant, an emulsion stabilizer, an antiseptic agent, an antifoaming agent, a viscosity adjusting agent, a dispersion stabilizer, a chelating agent, or the like.

Action and Beneficial Effects

According to the present embodiment, since a composition is adopted in which an anti-drying liquid is caused to flow on the nozzle surface and this liquid is then circulated, it is possible to prevent drying of the ink inside the nozzles because the peripheral area of the nozzles is humidified by evaporation of the liquid during its flow over the nozzle surface. Furthermore, since fresh anti-drying liquid flows in a continuous fashion, then the composition of the anti-drying liquid is stabilized and a valuable effect in preventing drying is obtained.

Another beneficial effect apart from this is that even if paper powder or ink mist becomes mixed into the anti-drying liquid due to the flow of the liquid, since the liquid flows without stagnating, it is possible to display a sufficient humidifying effect and furthermore, it is also possible to keep the nozzle surface clean.

Modification Example 1

Figure 8:
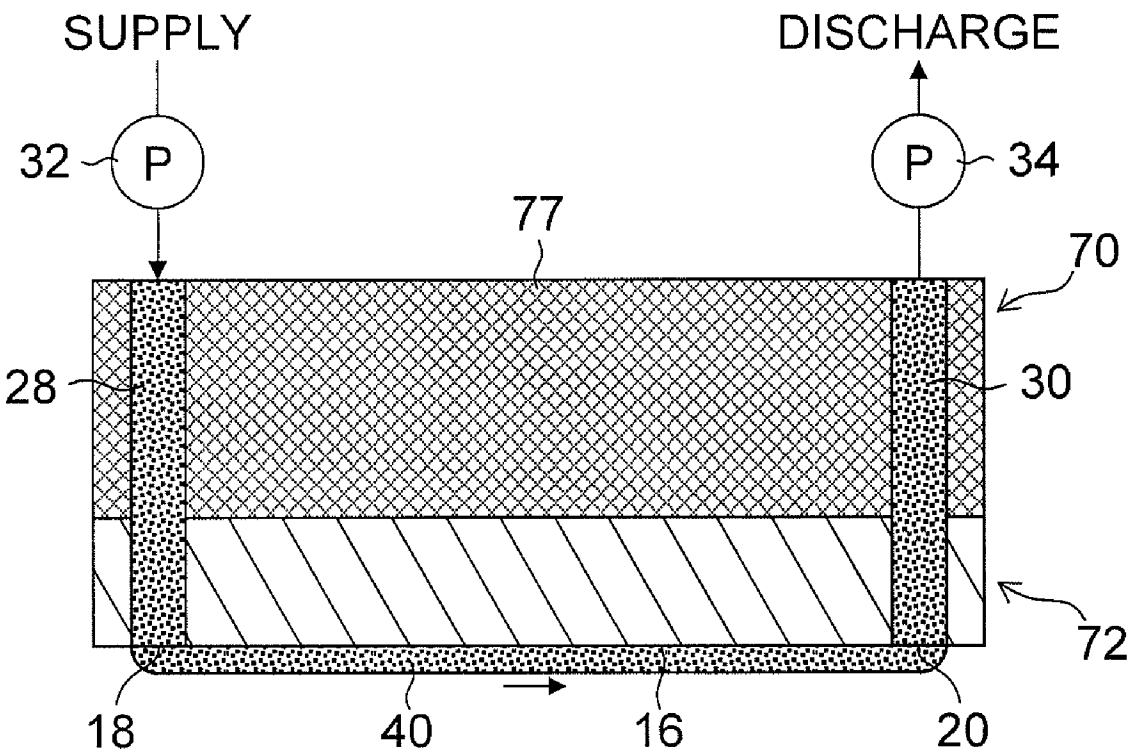
FIG. 8 is a cross-sectional diagram along line 8-8 in FIG. 7.

FIG. 7 is a plan diagram illustrating a head module 70 relating to a further embodiment as viewed from the ejection surface side of the nozzle plate 72. Furthermore, FIG. 8 illustrates a cross-sectional diagram along line 8-8 in FIG. 7. In FIG. 7 and FIG. 8, elements which are the same as or similar to the composition illustrated in FIGS. 1 and 2 are labelled with the same reference numerals and description thereof is omitted here.

The example illustrated in FIG. 7 and FIG. 8 is a mode where a supply port 18 and a discharge port 20 for the anti-drying liquid are provided in the nozzle plate 72. Although not illustrated in FIG. 8, flow channels such as flow channels of a kind which form ink passage channels to the nozzles 14, pressure chambers, common flow channels, and the like, are formed in the rear side portion of the nozzle plate 72 in the head module 70. In particular, in the case of a high-density head in which a lot of nozzles are formed at high density, there are cases where it is difficult to form a supply channel 28 and a discharge channel 30 for the anti-drying liquid which passes through the structure 77 of the flow channels, without interfering with the flow channels of the ink. In such cases, as illustrated in FIG. 1 and FIG. 2, a desirable mode is one where members (reference numerals 22 and 24) which form a supply port 18 and a discharge port 20 for the anti-drying liquid are formed to the outside of the nozzle plate.

Modification Example 2

Figure 9:
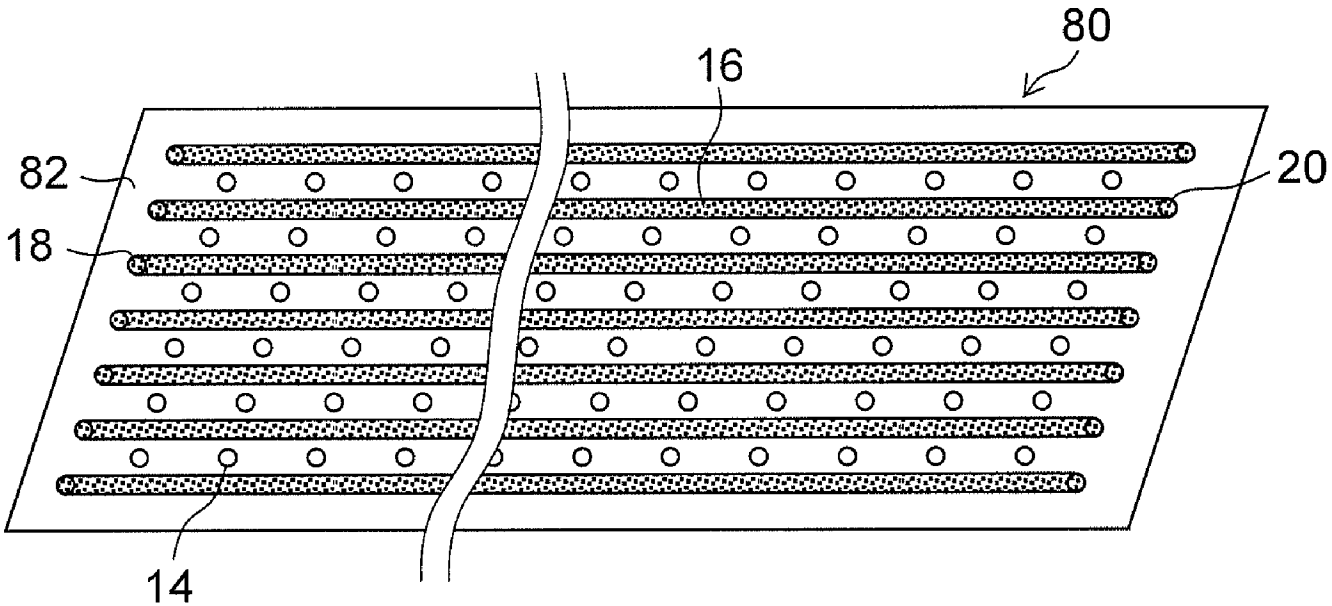
FIG. 9 is a plan diagram illustrating a head module according to another embodiment of the invention, viewed from the ejection surface side of the nozzle plate.

FIG. 9 is a plan diagram illustrating a head module 80 relating to yet a further embodiment as viewed from the ejection surface side of the nozzle plate 82. In FIG. 9, elements which are the same as or similar to the composition illustrated in FIGS. 1 and 7 are labelled with the same reference numerals and description thereof is omitted here.

In the mode illustrated in FIG. 1 and FIG. 7, lyophilic portions 16 through which the anti-drying liquid flows are formed following the shorter edges of the nozzle plate 12, 72, but the mode of the portions through which the anti-drying liquid flows (lyophilic portions 16) is not limited to this and as illustrated in FIG. 9, these portions may also be parallel to the longer edges of the nozzle plate 82 or have a meandering shape (not illustrated). The pattern of lyophilic portions 16 is designed on the basis of the dimensions, such as the nozzle pitch, in such a manner that the anti-drying liquid can flow readily and flows to the portions where a humidifying effect is obtained.

Modification Example 3

Figure 10C:
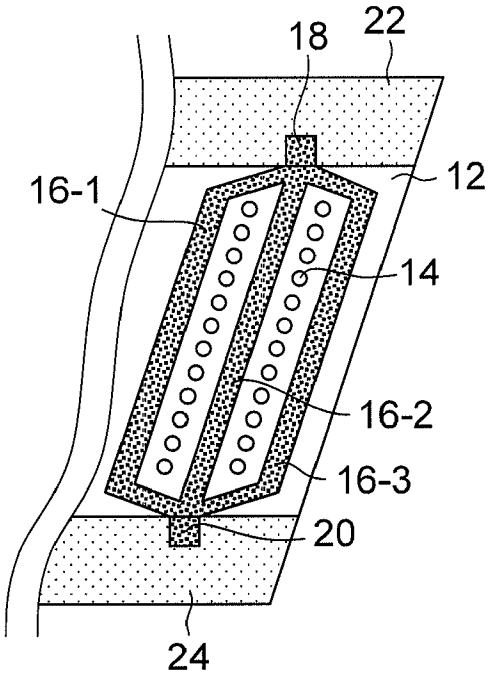
FIGS. 10A to 10C are diagrams illustrating examples of flow channels for an anti-drying liquid formed on a nozzle surface.
Figure 10B:
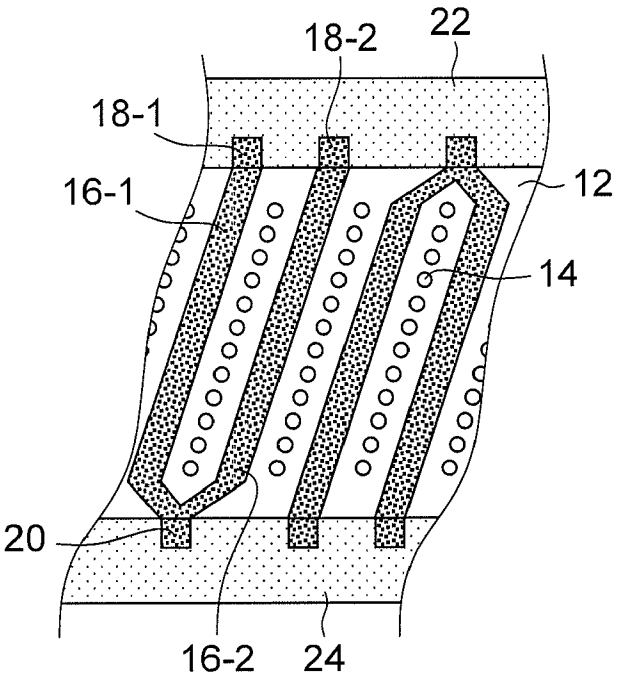
Figure 10A:
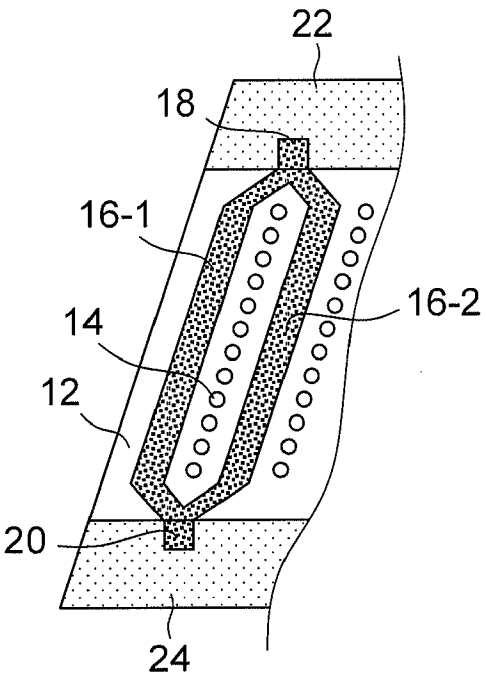

In the modes illustrated in FIG. 1, FIG. 7 and FIG. 9, a supply port 18 and a discharge port 20 are provided in a one-to-one correspondence with respect to the portions (lyophilic portions 16) where the anti-drying liquid flows, but as illustrated in FIGS. 10A to 10C, it is also possible to provide one set of a supply port 18 and a discharge port 20 for a plurality of portions where the anti-drying liquid flows, and it is also possible for the number of supply ports 18 and discharge ports 20 to be different. FIG. 10A is an example where a common set comprising a supply port 18 and a discharge port 20 are provided in respect of two lyophilic portions 16-1 and 16-2 through which the anti-drying liquid flows respectively. In FIG. 10B, supply ports 18-1 and 18-2 are provided respectively for the two lyophilic portions 16-1 and 16-2, and one discharge port 20 is formed for these two lyophilic portions 16-1 and 16-2. It is also possible to adopt a mode where the relationship of supply ports and discharge ports can be interchanged.

FIG. 10C illustrates an example where a common set comprising a supply port 18 and a discharge port 20 are provided in respect of three lyophilic portions 16-1, 16-2 and 16-3 through which the anti-drying liquid flows respectively.

Furthermore, if channels along which the anti-drying liquid flows (lyophilic portion 16) are provided in all the regions between the nozzle rows as illustrated in FIG. 1, then the humidifying effect is high, but the used amount of anti-drying liquid becomes large, and therefore it is possible to form the flow channels for the anti-drying liquid on the nozzle surface at appropriate intervals, for instance, by providing one anti-drying liquid flow channel for two nozzle rows, within a range whereby the desired humidifying effect is obtained.

Examples of Dimensions

Figure 11:
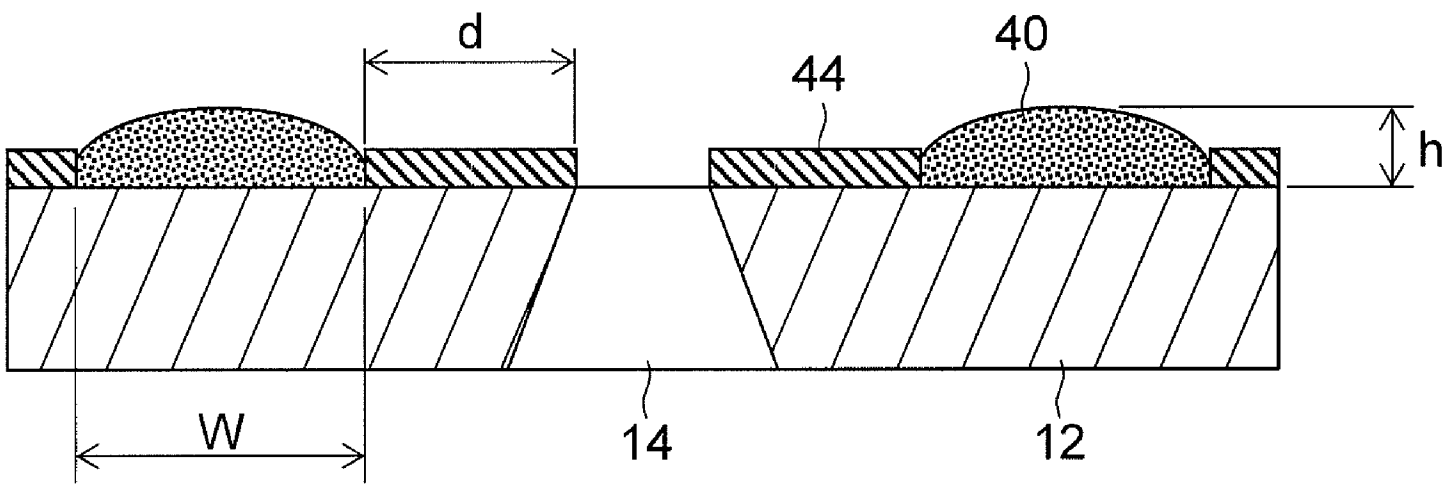
FIG. 11 is an explanatory diagram for specific sizes.
Figure 12:
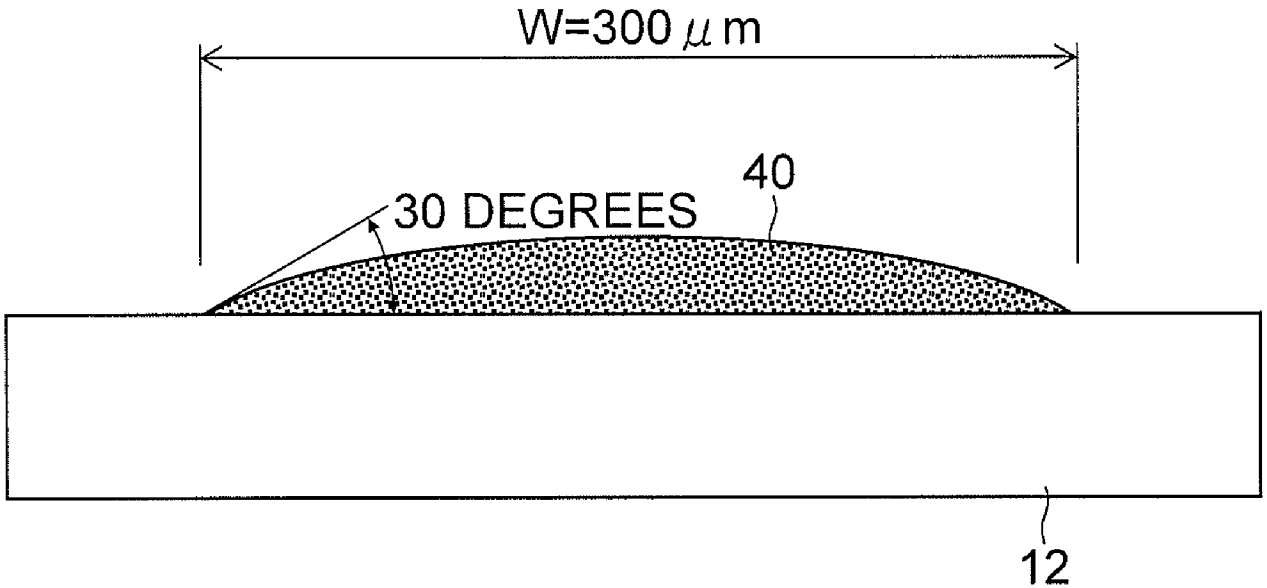
FIG. 12 is a cross-sectional diagram of an anti-drying liquid flowing on the nozzle surface.

FIG. 11 illustrates examples of dimensions. For example, the distance d from the edge of the nozzle 14 to the lyophilic portion 16 are designed appropriately in the ranges of 10 to 200 μm and the width W of the lyophilic portion 16 (the width of the flow channel through which the anti-drying liquid 40 flows) are designed appropriately in the ranges of 80 to 800 μm. The height h of the anti-drying liquid is determined by the width W, the angle of contact with the nozzle surface, and the supply volume of anti-drying liquid.

The flow rate of the anti-drying liquid depends on the use environment of the head (temperature, humidity), but to give an example, if the width W of the flow channels for the anti-drying liquid is 300 μm, the length of the flow channel (the length L from the supply port 18 to the discharge port 20, see FIG. 1) is 20 mm, and the angle of contact with respect to the nozzle surface is 30 degrees, then the flow rate is 1 to 5 μL/min in each channel. For example, if the liquid flows in 5 seconds along a flow channel having a length of 20 mm, then the flow rate is 2 μL/min.

Shape of Portion where Anti-Drying Liquid Flows

Figure 13A:
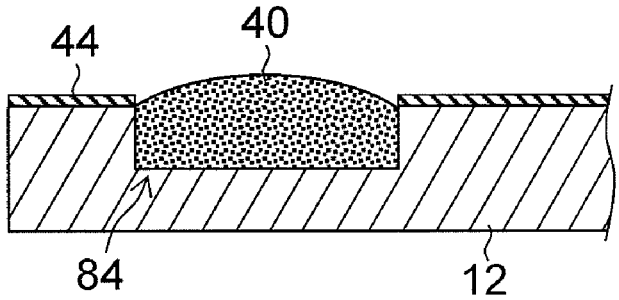
FIGS. 13A and 13B are cross-sectional diagrams illustrating examples of a groove on the nozzle surface
Figure 13B:
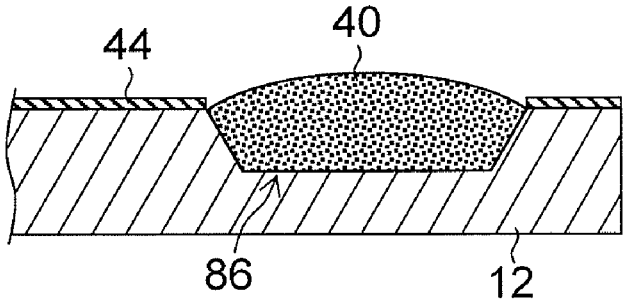

Rather than simply rendering lyophilic the portion where the anti-drying liquid flows on the nozzle surface, it is also possible to form a groove and then render this groove portion lyophilic. Examples of groove shapes are illustrated in FIGS. 13A and 13B. FIGS. 13A and 13B are cross-sectional diagrams illustrating the shape of such a groove in a cross-section perpendicular to the direction of flow of the anti-drying liquid 40 (the cross-sectional shape of the flow channels formed by the grooves). There is a mode which adopts a square-shaped groove 84 as illustrated in FIG. 13A and a mode which adopts an inverse-trapezoid-shaped groove 86 as illustrated in FIG. 13B. By rendering the groove portions lyophilic in this way, the holding force of the anti-drying liquid is further improved. Of course, the cross-sectional shape of the grooves is not limited to the examples illustrated in the drawings.

Temperature Adjustment of Anti-Drying Liquid

Desirably, the anti-drying liquid 40 supplied to the nozzle surface is heated and controlled to a prescribed temperature. In general, an inkjet head is adjusted to a specified temperature in order to stabilize ejection performance, and the like, but desirably, the anti-drying liquid flowing on the nozzle surface is heated and adjusted to a higher temperature than the head temperature. By this means, it is possible to promote the evaporation of the anti-drying liquid on the nozzle surface.

Combined Use of Other Viscosity Increase Prevention Methods

Known methods of preventing increase in viscosity in the ink inside the nozzles include a method which circulates the ink inside the nozzles, and a method which causes the meniscus inside a nozzle to vibrate slightly without being ejected (meniscus shaking). By combining the use of these viscosity increase prevention methods and the anti-drying liquid circulating technology according to embodiments of the present invention, an even greater effect in preventing increase in viscosity is obtained.

Increasing the Length of the Head

Figure 14:
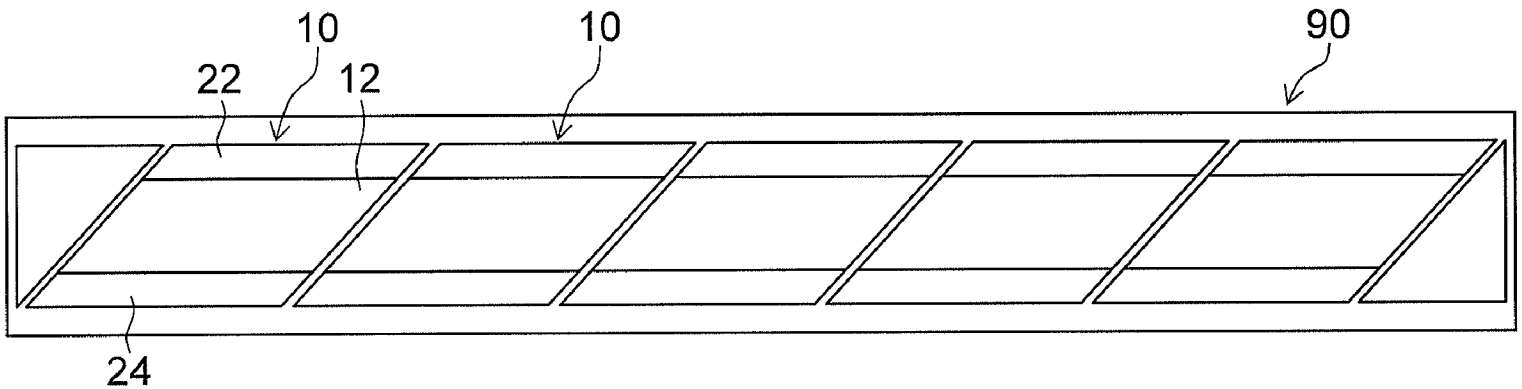
FIG. 14 is a diagram illustrating a configuration example of a long line head manufactured by connecting head modules.

It is possible to adopt a mode in which main scanning direction nozzle rows corresponding to the maximum paper width are achieved using singly the head module 10 explained with reference to FIG. 1, and it is also possible to adopt a mode in which a long line head 90 achieving main scanning direction nozzle rows corresponding to the maximum paper width is formed by aligning in one row and joining together a plurality of head modules 10 each having a substantially parallelogram-shaped planar faun as illustrated, for example, in FIG. 14.

Second Embodiment

Figure 15:
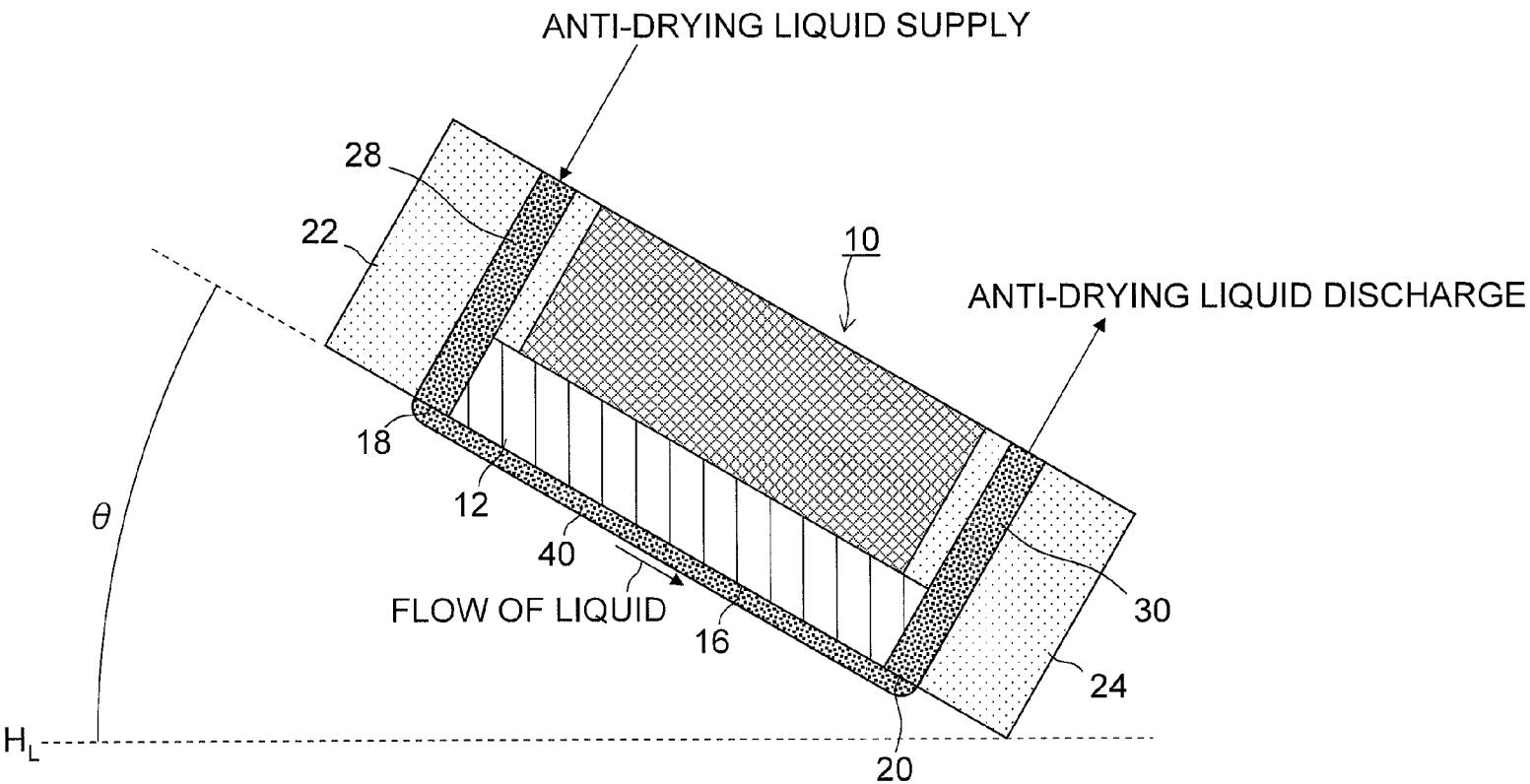
FIG. 15 is a cross-sectional diagram illustrating a second embodiment of the present invention.

As illustrated in FIG. 15, a desirable mode is one in which the nozzle surface 12A of the head module 10 is disposed at an inclination of angle θ with respect to the horizontal plane HL and the anti-drying liquid 40 is made to flow over the nozzle surface so as to travel in a vertical direction following this inclination. In FIG. 15, elements which are the same as or similar to the composition illustrated in FIGS. 1 and 2 are labelled with the same reference numerals and description thereof is omitted here.

A case where a head is disposed about the periphery of a drum, for example, (see FIG. 16) is one mode of an apparatus where the nozzle surface 12A is disposed at an inclination as illustrated in FIG. 15.

According to the composition in FIG. 15, the flow of anti-drying liquid 40 is made smooth by the additional effect of gravity. Furthermore, the anti-drying liquid 40 never drips off from the nozzle surface 12A.

As regards the angle of inclination θ of the nozzle surface 12A with respect to the horizontal plane HL, in the case of a two-dimensional matrix arrangement in particular, the larger the angle θ, the difference in back pressure between nozzles becomes greater and ejection becomes less stable. Therefore it is desirable to set θ to the range of 3° to 30° with respect to the horizontal direction.

Example of Application to Inkjet Recording Apparatus

Next, an example of an image forming apparatus which uses the inkjet head comprising the nozzle plate described above will be explained.

Figure 16:
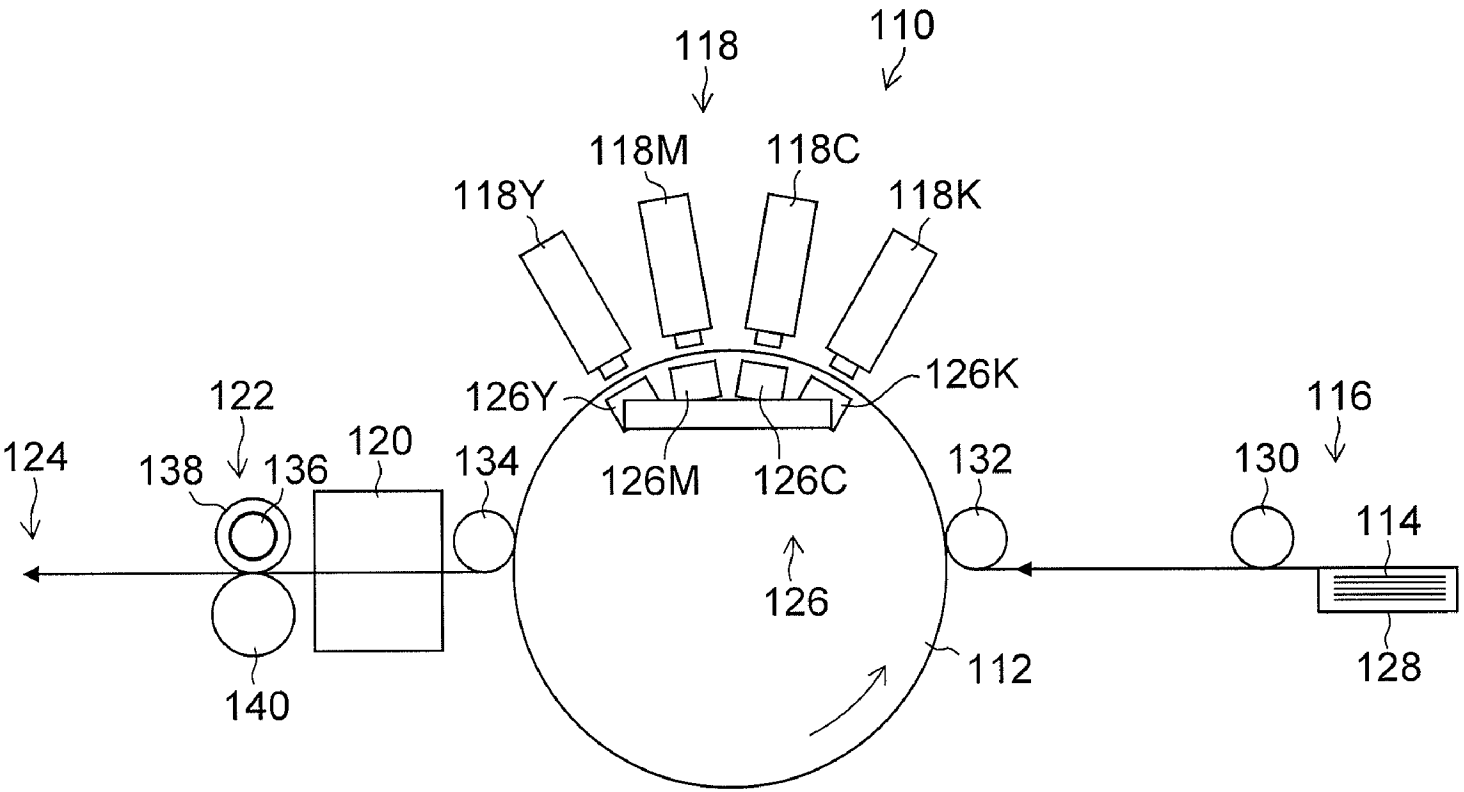
FIG. 16 is a general schematic drawing of an inkjet recording apparatus relating to an embodiment of the present invention.

FIG. 16 is a general configuration diagram of an inkjet recording apparatus including an image forming apparatus according to an embodiment of the present invention. As illustrated in FIG. 16, an inkjet recording apparatus 110 according to the present embodiment adopts a pressure drum direct describing system which forms an image directly onto a recording medium held on the circumferential surface of a pressure drum 112.

The inkjet recording apparatus 110 principally comprises: a pressure drum 112 which holds and conveys a recording medium on the circumferential surface thereof; a paper supply unit 116 which supplies a recording medium 114; a print unit 118 which performs image formation by depositing colored inks onto a recording medium 114 held by the pressure drum 112; a solvent drying unit 120 which dries the solvent of the ink; a fixing processing unit 122 which makes the image permanent; an output unit 124 which conveys and outputs the recording medium 114 onto which an image has been formed; and a maintenance processing unit 126 which carries out maintenance processing of the inkjet heads 118K, 118C, 118M and 118Y of the print unit 118.

A paper supply tray 128 which supplies recording media 114 in the form of cut sheet is provided in the paper supply unit 116. A recording medium 114 fed out from the paper supply tray 128 by the paper supply roller 130 is supplied onto the circumferential surface of the pressure drum 112 via a guide roller 132 and is held on the circumferential surface of the pressure drum 112.

It is also possible to use a recording medium of a continuous format which is wound in a roll shape, instead of a recording medium 114 in a cut paper format. If using recording medium in a continuous paper format, a device for holding the paper roll and a cutter for cutting a long recording medium to a prescribed size are provided.

Although not illustrated in the drawings, a plurality of suction holes are disposed according to a prescribed arrangement pattern on the circumferential surface of the pressure drum 112, and the region where the plurality of suction holes are disposed functions as a recording medium holding region which suctions and holds a recording medium. The suction holes are connected to the suction flow channels provided inside the pressure drum 112 as well as being connected to an external suctioning apparatus (pump) via the suction flow channels. Instead of a negative pressure suctioning method described above, it is also possible to employ an electrostatic attraction method which holds a recording medium 114 on the recording medium holding region of the pressure drum 112 by means of static electricity. Since the conveyance of the recording medium is stable, then it is possible to reduce conveyance errors.

The print unit 118 has inkjet heads (hereinafter, simply called "heads") 118K, 118C, 118M and 118Y corresponding to the four colors of black (K), cyan (C), magenta (M) and yellow (Y) which are provided at positions opposing the circumferential surface of the pressure drum 112, and carries out image recording by ejecting inks of respective colors in accordance with image data onto a recording medium 114 held on the circumferential surface of the pressure drum 112.

As illustrated in FIG. 16, the heads 118K, 118C, 118M and 118Y are disposed at an oblique inclination with respect to the horizontal plane, following the circumferential surface of the pressure drum 112. In other words, the heads 118K, 118C, 118M and 118Y are disposed in such a manner that the perpendicular direction to the nozzle surfaces (ink ejection surface) of the respective heads 118K, 118C, 118M and 118Y coincides with the normal direction of the circumferential surface of the pressure drum 112, and the distance between the ink ejection surfaces of the heads 118K, 118C, 118M and 118Y and the droplet ejection position on the pressure drum 112 (namely, on the recording medium 114) is the same in each of the heads 118K, 118C, 118M and 118Y. In particular, by disposing the heads in a circular arc shape about the periphery of the pressure drum 112, the depositing position accuracy dependent on the droplet ejection distance is guaranteed and it becomes possible to form images of high quality.

Although a configuration with the four standard colors of K, C, M and Y is depicted in FIG. 16, the combinations of the ink colors and the number of colors are not limited to those. Light and/or dark inks, and special color inks can be added as required. For example, a configuration is possible in which ink heads for ejecting light-colored inks, such as light cyan and light magenta, red, blue, gold and silver, are added, and there is no particular restriction on the arrangement sequence of the heads of the respective colors.

A solvent drying unit 120 is provided at a downstream stage from the print unit 118. A recording medium 114 on which image recording has been carried out is supplied to the solvent drying unit 120 via a guide roller 134 and a solvent drying process is carried out. In the solvent drying unit 120, a hot wind of 50° C. to 130° C. is blown onto the image recording surface of the recording medium 114, and the solvent, such as water, remaining on the image recording surface of the recording medium 114 is evaporated off. As a further mode of the solvent drying unit 120, it is also possible to use, instead of or in combination with the hot air drying method, heating by a radiation method using an infrared heater, or a contact drying method in which a heated roller with an in-built heater is brought into contact with the recording medium 114 from the surface on the opposite side to the image forming surface of the medium. In other words, desirably, the solvent is dried without making contact with the image recording surface, and contact soiling inside the apparatus due to incomplete drying, or rear surface soiling due to stacking of the output recording media, and the like, is prevented.

A fixing processing unit 122 which carries out a fixing process on the recording medium 114 after the drying process is provided at a downstream stage after the solvent drying unit 120. The fixing processing unit 122 illustrated in FIG. 16 comprises a heating roller 138 having an in-built heater 136 and a supporting roller 140 which is disposed on the opposite side of the heating roller 138 via the conveyance path of the recording medium.

A recording medium 114 which has undergone a drying process is sandwiched between the heating roller 138 and the supporting roller 140 while the image recording surface is toward the heating roller 138 side, the image recording surface of the recording medium 114 is heated via the heating roller 138 by the heat radiated from the heater 136, and the recording medium 114 is pressurized by the pressing force of the heating roller 138 and the supporting roller 140. By this means, the wear resistance of the image portion of the recording medium is improved.

A recording medium 114 which has undergone a fixing process by the fixing process unit 122 is output to the exterior of the apparatus via the output unit 124. A desirable mode of the output unit 124 is one in which a sorter is provided in such a manner that media are distinguished and output separately according to each image (or according to order).

The maintenance processing unit 126 has maintenance units 126K, 126C, 126M and 126Y corresponding respectively to the heads 118K, 118C, 118M and 118Y. As illustrated in FIG. 16, the maintenance units 126K, 126C, 126M and 126Y are disposed in an obliquely inclined fashion with respect to the horizontal plane, so as to be parallel with the heads 118K, 118C, 118M and 118Y.

The maintenance processing unit 126 is disposed in a maintenance position which is separated in the direction perpendicular to the plane of the drawing in FIG. 16, from the print position where the pressure drum 112 is disposed. In FIG. 16, by moving the heads 118K, 118C, 118M and 118Y in parallel in the perpendicular direction with respect to the plane of the drawings, it is possible to move the heads 118K, 118C, 118M and 118Y between a print position directly above the pressure drum 112 and a maintenance position.

Structure of Head

Next, the structure of a head will be described. The heads 118K, 118C, 118M and 118Y of the respective ink colors have the same structure, and a reference numeral 150 is hereinafter designated to any of the heads 118K, 118C, 118M and 118Y.

Figure 17A:
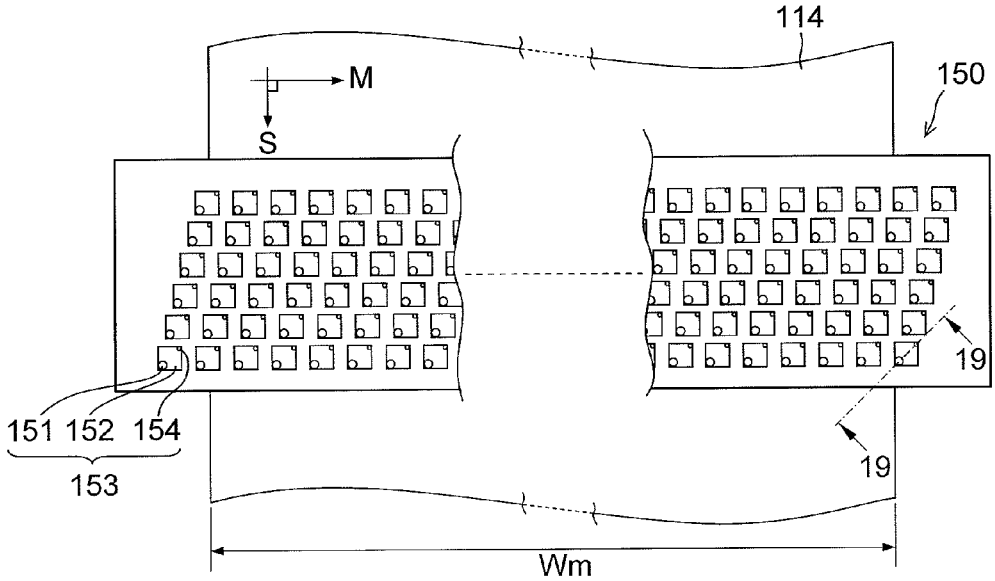
FIGS. 17A and 17B are plan view perspective diagrams illustrating an example of the composition of a print head.
Figure 17B:
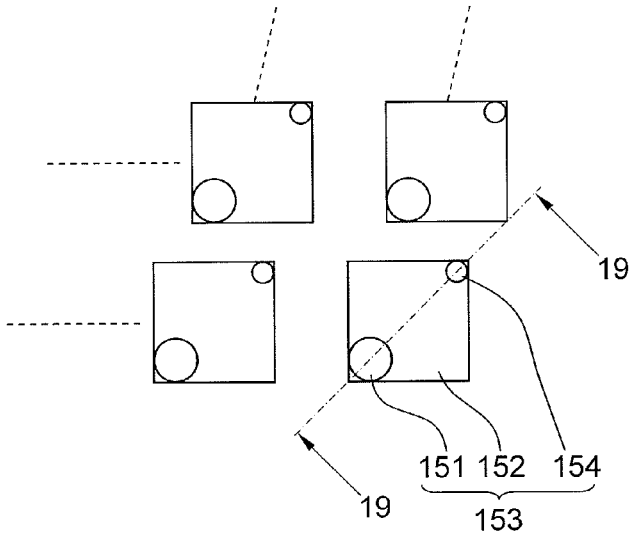
Figure 18:
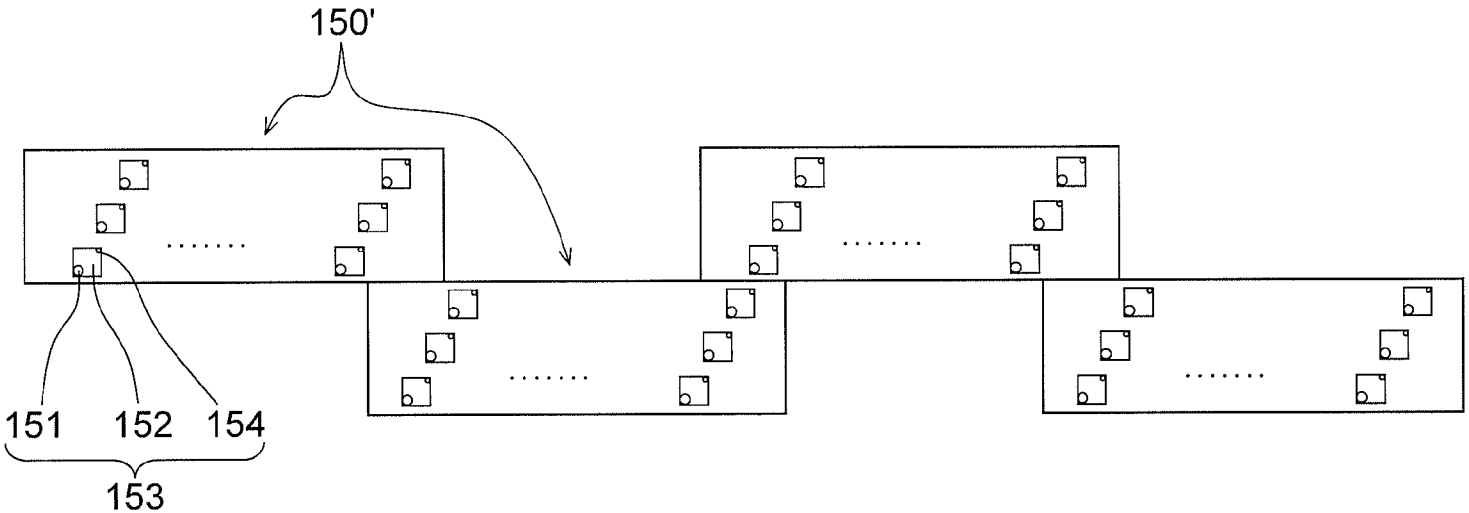
FIG. 18 is a plan view perspective diagram illustrating a further example of the structure of a full line head.
Figure 19:
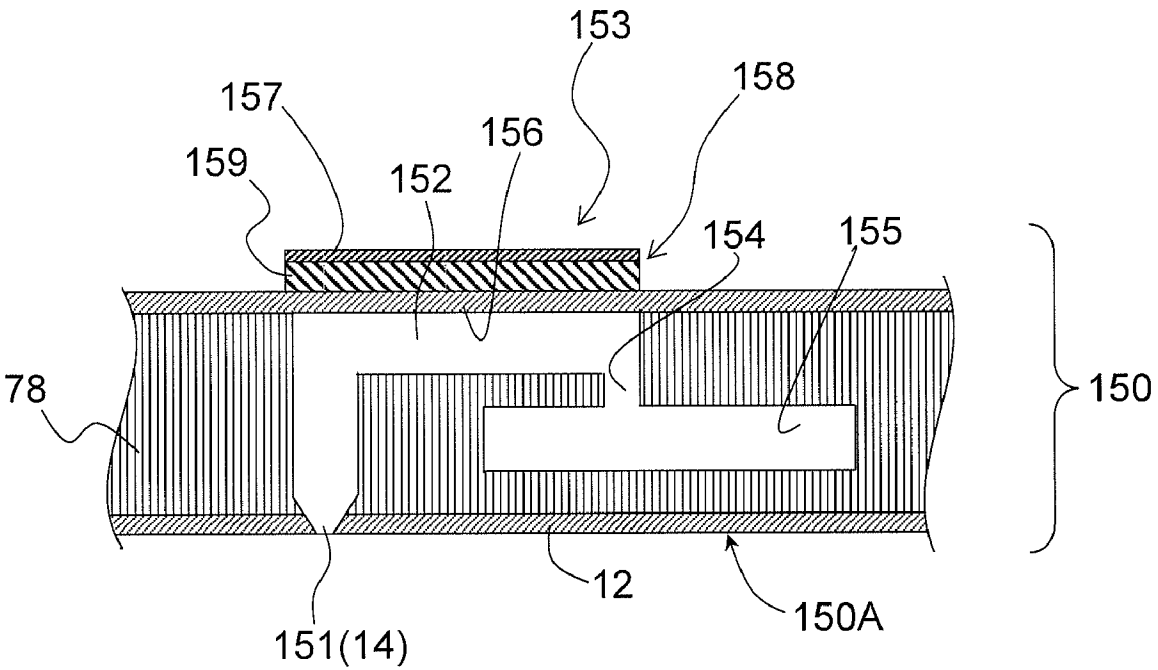
FIG. 19 is a cross-sectional diagram along line 19-19 in FIGS. 17A and 17B.

FIG. 17A is a perspective plan view illustrating an example of the configuration of the head 150, and FIG. 17B is an enlarged view of a portion thereof. Further, FIG. 18 is a perspective plan view illustrating another example of the configuration of the head 150, and FIG. 19 is a cross-sectional view taken along line 19-19 in FIGS. 17A and 17B, illustrating the inner structure of a droplet ejection element of one flow channel constituting a recording element unit (an ink chamber unit for one nozzle 151). For simplified explanation, flow channels for the anti-drying liquid are omitted from FIGS. 17A, 17B, 18 and 19.

The nozzle pitch in the head 150 should be minimized in order to maximize the density of the dots printed on the surface of the recording medium 114. As illustrated in FIGS. 17A and 17B, the head 150 according to the present embodiment has a structure in which a plurality of ink chamber units (droplet ejection elements) 153, each comprising a nozzle 151 (equivalent to nozzles 14 in FIG. 1) forming an ink ejection port, a pressure chamber 152 corresponding to the nozzle 151, and the like, are disposed two-dimensionally in the form of a staggered matrix, and hence the effective nozzle interval (the projected nozzle pitch) as projected (orthogonal projection) in the lengthwise direction of the head (the direction perpendicular to the paper conveyance direction) is reduced and high nozzle density is achieved.

The mode of forming nozzle rows of a length greater than the length corresponding to the entire width Wm of the recording medium 114 in a direction (the direction indicated by arrow M; the main-scanning direction) substantially perpendicular to the conveyance direction of the recording medium 114 (the direction indicated by arrow S; the sub-scanning direction) is not limited to the example described above. For example, instead of the configuration in FIG. 17A, as illustrated in FIG. 18, a line head having nozzle rows of a length corresponding to the entire width of the recording medium 114 can be formed by arranging and combining, in a staggered matrix, short head modules 150' having a plurality of nozzles 151 arrayed in a two-dimensional fashion.

As illustrated in FIGS. 17A and 17B, the planar shape of the pressure chamber 152 provided for each nozzle 151 is substantially a square, and an outlet to the nozzle 151 is provided in one of corners on a diagonal line of the square, and an inlet of supplied ink (supply port) 154 is provided in the other corner. The shape of the pressure chamber 152 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As illustrated in FIG. 19, the head 150 is formed by a structure in which a nozzle plate 12, a flow channel plate 78, a diaphragm 156, and the like, are laminated and bonded together.

The nozzle plate 12 is manufacture according to the manufacturing method illustrated in FIGS. 3A to 3C and 6A to 6C, and the like. This nozzle plate 12 forms the nozzle surface (ink ejection surface) 150A of the head 150, and a plurality of nozzles 151 which are respectively connected to the pressure chambers 152 are formed in a two-dimensional configuration in the nozzle plate 12.

The flow channel plate 78 is a flow channel forming member which constitutes the side wall sections of the pressure chambers 152, and forms a supply port 154 constituting a restrictor section (narrowest section) of the independent supply channel that guides ink from the common flow channel 155 into the pressure chamber 152. For the purpose of the description, FIG. 18 illustrates a simplified depiction, but the flow channel plate 78 in fact has a structure in which one or a plurality of substrates are laminated together.

As well as forming one side surface of the pressure chambers 152 (the upper surface in FIG. 19), the diaphragm 156 is made of a conductive material such as stainless steel (SUS) or silicon (Si) with a nickel (Ni) conductive layer, or the like, and therefore also serves as a common electrode for the plurality of actuators (here, the piezoelectric elements) 158 which are disposed so as to correspond to the respective pressure chambers 152. A mode is also possible in which a diaphragm is formed by a non-conductive material, such as resin, and in this case, a common electrode layer made of a conductive material, such as metal, is formed on the surface of the diaphragm member.

A piezoelectric body 159 is provided on the surface of the diaphragm 156 on the side opposite to the pressure chambers 152 (the upper side in FIG. 19) at each position corresponding to the pressure chambers 152, and an individual electrode 157 is formed on the upper surface of the piezoelectric body 159 (the surface of the piezoelectric body 159 on the side opposite to the surface in contact with the diaphragm 156 which also serves as a common electrode). A piezoelectric element which functions as an actuator 158 is constituted by the individual electrode 157, the common electrode opposing same (in the present embodiment, this also doubles as the diaphragm 156), and the piezoelectric body 159 which is interposed between these two electrodes. As the material of the piezoelectric body 159, it is desirable to use a piezoelectric material, such as lead titanate zirconate, barium titanate, or the like.

Each pressure chamber 152 is connected to a common flow channel 155 through the supply port 154. The common flow channel 155 is connected to an ink tank (not illustrated), which is a base tank that supplies ink, and the ink supplied from the ink tank is delivered through the common flow channel 155 to the pressure chambers 152.

When a drive voltage is applied to the individual electrode 157 of the actuator 158 and the common electrode, the actuator 158 deforms, thereby changing the volume of the pressure chamber 152. This causes a pressure change which results in ink being ejected from the nozzle 151. When the displacement of the actuator 158 returns to its original position after ejecting ink, the pressure chamber 152 is supplied with new ink from the common flow channel 155, via the supply port 154.

Figure 20:
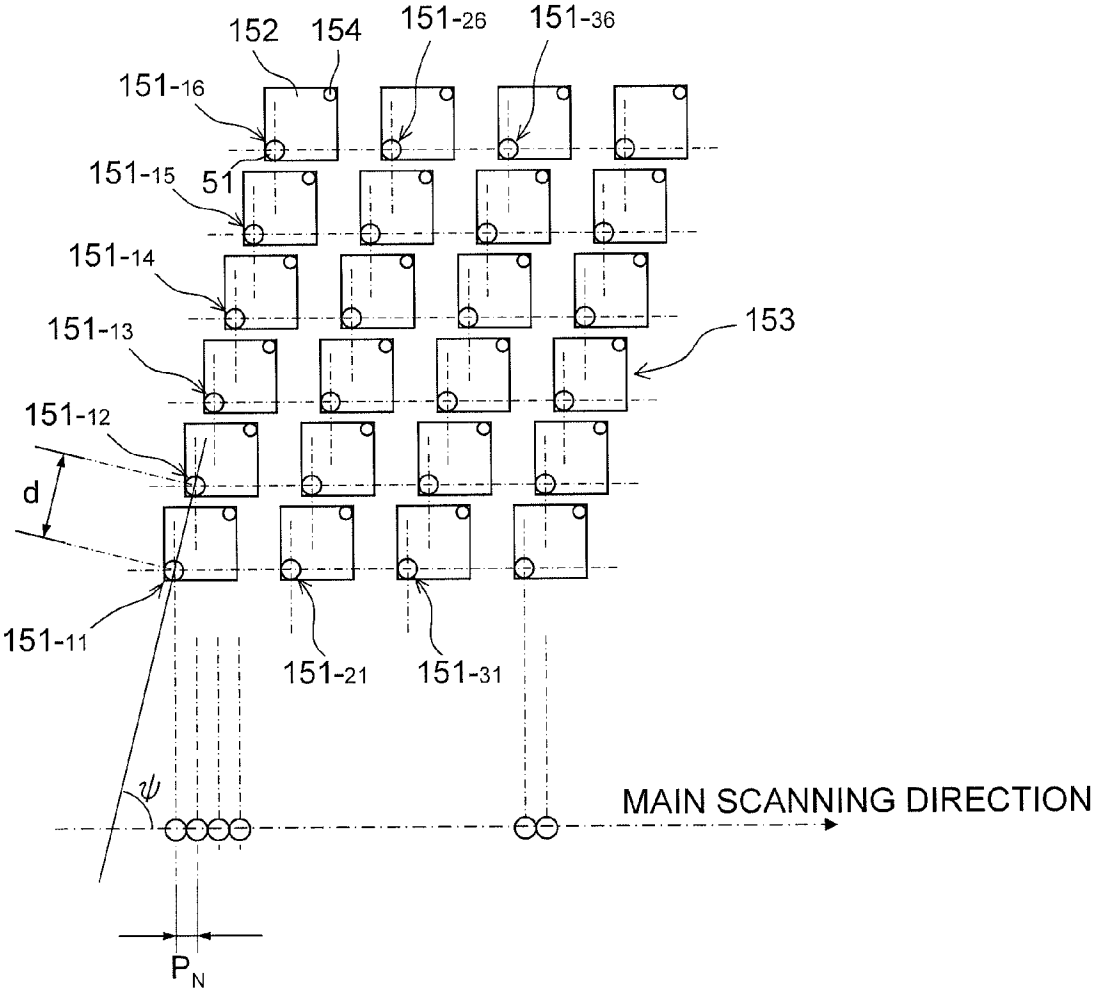
FIG. 20 is an enlarged view illustrating a nozzle arrangement in the print head illustrated in FIGS. 17A and 17B.

As illustrated in FIG. 20, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of w with respect to the main scanning direction, rather than being perpendicular to the main scanning direction.

More specifically, by adopting a structure in which a plurality of ink chamber units 153 are arranged at a uniform pitch d in line with a direction forming an angle of w with respect to the main scanning direction, the pitch PN of the nozzles projected so as to align in the main scanning direction is $d \times \cos \psi$, and hence the nozzles 151 can be regarded to be substantially equivalent to those arranged linearly at a fixed pitch PN along the main scanning direction.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that illustrated in FIG. 20 are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block; . . . ); and one line is printed in the width direction of the recording medium 114 by sequentially driving the nozzles 151-11, 151-12, . . . , 151-16 in accordance with the conveyance velocity of the recording medium 114.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by the main scanning as described above is called the "main scanning direction", and the direction in which sub-scanning is performed, is called the "sub-scanning direction". In other words, in the present embodiment, the conveyance direction of the recording medium 114 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

Figure 21:
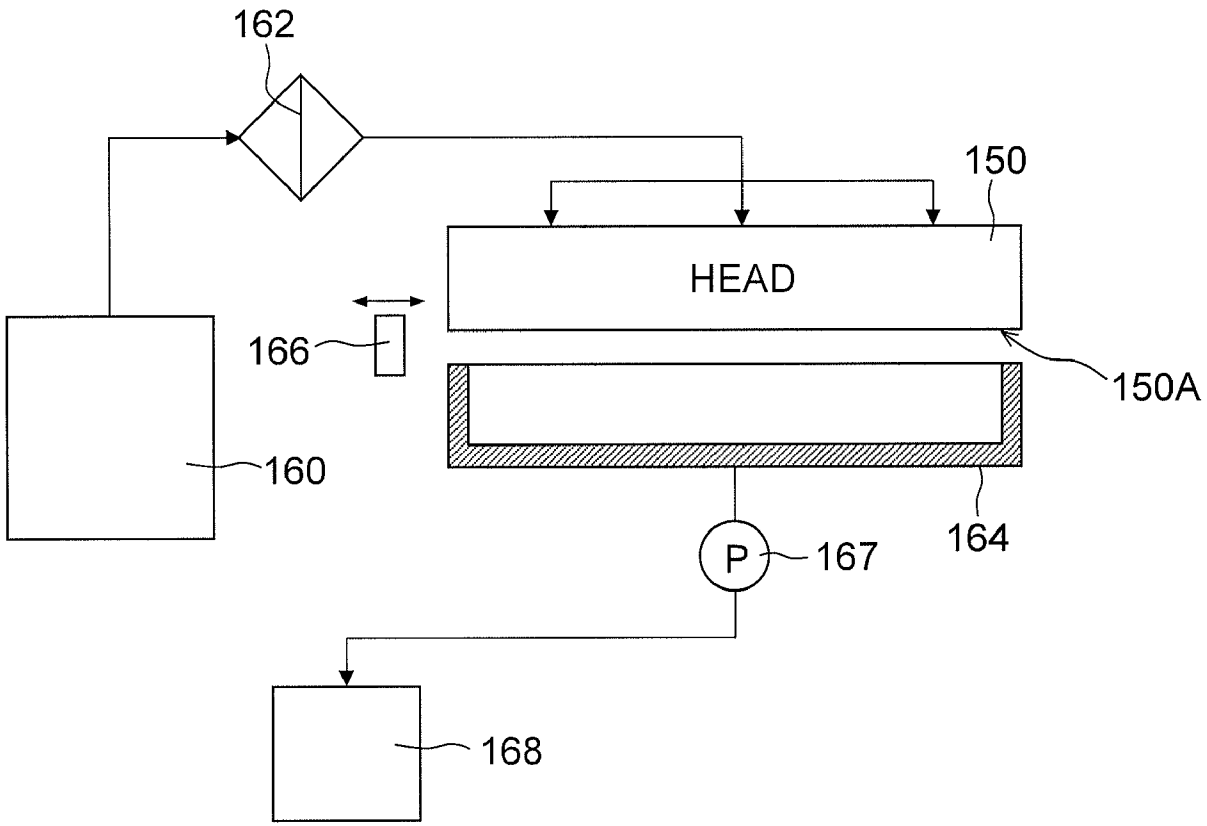
FIG. 21 is a schematic drawing of an ink supply system.

FIG. 21 is a schematic drawing illustrating the configuration of the ink supply system in the inkjet recording apparatus 110. The ink tank 160 is a base tank that supplies ink to the head 150 and is set in the ink storing and loading unit 114 described with reference to FIGS. 10A to 10C. In other words, the ink tank 160 in FIG. 15 is equivalent to the ink storage and loading unit 114 in FIGS. 10A to 10C. The aspects of the ink tank 160 include a refillable type and a cartridge type: when the remaining amount of ink is low, the ink tank 160 of the refillable type is filled with ink through a filling port (not illustrated) and the ink tank 160 of the cartridge type is replaced with a new one. In order to change the ink type in accordance with the intended application, the cartridge type is suitable, and it is desirable to represent the ink type information with a bar code or the like on the cartridge, and to perform ejection control in accordance with the ink type.

A filter 162 for removing foreign matters and bubbles is disposed between the ink tank 160 and the head 150 as illustrated in FIG. 21. The filter mesh size of the filter 162 is desirably equivalent to or less than the diameter of a nozzle. Although not illustrated in FIG. 21, it is desirable to provide a sub-tank integrally to the print head 150 or nearby the head 150. The sub-tank has a damper function for preventing variation in the internal pressure of the head and a function for improving refilling of the print head.

The inkjet recording apparatus 110 is also provided with a cap 164 as a device to prevent the nozzles 151 from drying out or to prevent an increase in the ink viscosity in the vicinity of the nozzles 151, and a cleaning blade 166 as a device to clean the nozzle face 150A. A maintenance unit (restoration device) including the cap 164 and the cleaning blade 166 can be relatively moved with respect to the head 150 by a movement mechanism (not illustrated), and is moved from a predetermined holding position to a maintenance position below the head 150 as required.

The maintenance unit including the cap 164 and the cleaning blade 166 is equivalent to the maintenance unit 126K, 126C, 126M and 126Y of the maintenance processing unit 126 illustrated in FIG. 16.

The cap 164 illustrated in FIG. 21 is displaced up and down relatively with respect to the head 150 by an elevator mechanism (not illustrated). When the power of the inkjet recording apparatus 110 is turned OFF or when in a print standby state, the cap 164 is raised to a predetermined elevated position so as to come into close contact with the head 150, and the nozzle face 150A is thereby covered with the cap 164.

The cleaning blade 166 is composed of rubber or another elastic member, and can slide on the nozzle surface 150A (surface of the nozzle plate) of the head 150 by means of a blade movement mechanism (not illustrated). When ink droplets or foreign matter has adhered to the surface of the nozzle plate, the nozzle surface is wiped by sliding the cleaning blade 166 on the nozzle plate. Alternatively, the following is also possible: the position of the cleaning blade 166 is fixed, and the wiping is performed by moving the head 150 to the maintenance position.

During printing or standby, a preliminary discharge (dummy ejection operation) is made to eject the degraded ink toward the cap 164 (which also serves as an ink receptacle) in order to discharge ink in nozzles, as appropriate.

After the nozzle surface is cleaned by a wiper such as the cleaning blade 166 provided as the cleaning device for the nozzle face 150A, a preliminary discharge is also carried out in order to prevent the foreign matter from becoming mixed inside the nozzles 151 by the wiper sliding operation.

On the other hand, if air bubbles become intermixed into a nozzle 151 or a pressure chamber 152, or if the rise in the viscosity of the ink inside a nozzle 151 exceeds a certain level, then it may not be possible to eject ink in the dummy ejection operation described above. In cases of this kind, the cap 164 forming a suction device is pressed against the nozzle surface 150A of the print head 150, and the ink inside the pressure chambers 152 (namely, the ink containing air bubbles of the ink of increased viscosity) is suctioned by a suction pump 167. The ink suctioned and removed by means of this suction operation is sent to a recovery tank 168. The ink collected in the recovery tank 168 may be used, or if reuse is not possible, it may be discarded.

Since the suctioning operation is performed with respect to all of the ink in the pressure chambers 152, it consumes a large amount of ink, and therefore, desirably, restoration by preliminary ejection is carried out while the increase in the viscosity of the ink is still minor. The suction operation is also carried out when ink is loaded into the print head 150 for the first time, and when the head starts to be used after being idle for a long period of time.

Anti-Drying Liquid Supply System

Figure 22:
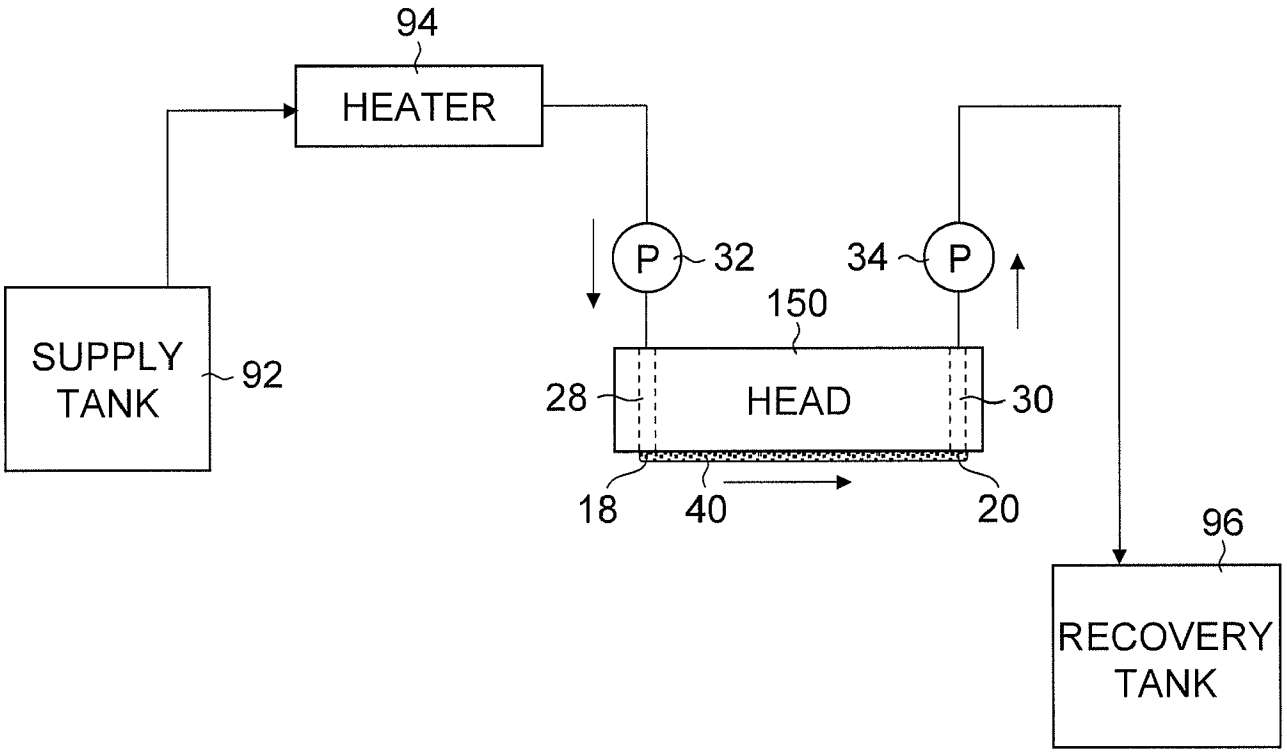
FIG. 22 is a configuration diagram illustrating a supply system for an anti-drying liquid.

FIG. 22 is a schematic drawing illustrating the composition of an anti-drying liquid supply system in the inkjet recording apparatus 110. In FIG. 22, anti-drying liquid to be supplied to the head 150 is stored in a supply tank 92 which is the same as or similar to the composition illustrated in FIG. 2. The anti-drying liquid fed out from the supply tank 92 is heated to a prescribed temperature by the heater 94 and then supplied to the head 150. By raising the temperature of the anti-drying liquid 40 which flows over the nozzle surface, the gasification (evaporation) of the anti-drying liquid 40 is promoted. Furthermore, the anti-drying liquid that has been recovered from the anti-drying liquid discharge port 20 of the head 150 is sent to a recovery tank 96 by driving the suction pump 34. The liquid recovered into the recovery tank 96 is subjected to processing for removing dirt by means of a filter (not illustrated) and for readjusting the composition, and so on, whereupon the liquid is returned to the supply tank 92 and can then be reused.

Description of Control System

Figure 23:
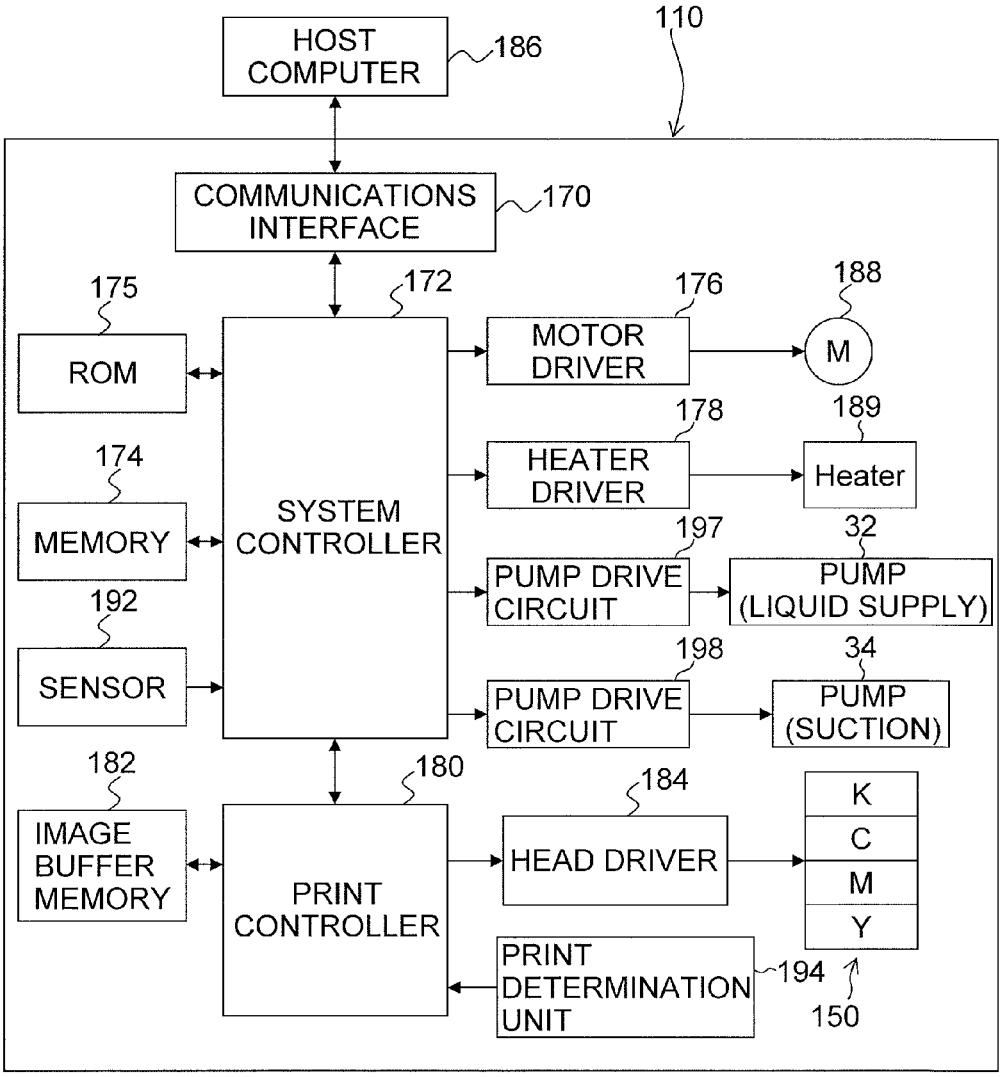
FIG. 23 is a principal block diagram illustrating the system configuration of an inkjet recording apparatus according to an embodiment of the invention.

FIG. 23 is a block diagram illustrating a system composition of the inkjet recording apparatus 110. As illustrated in FIG. 23, the inkjet recording apparatus 110 comprises a communications interface 170, a system controller 172, an image memory 174, a ROM 175, a motor driver 176, a heater driver 178, a print controller 180, an image buffer memory 182, a head driver 184, and the like.

The communications interface 170 is an interface unit (image data input device) for receiving image data which is transmitted by a host computer 186. For the communications interface 170, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications.

Image data sent from the host computer 186 is read into the image forming apparatus 110 via the communications interface 170, and is stored temporarily in the image memory 174. The image memory 174 is a storage device which stores an image input via the communications interface 170, and data is read from and written to the image memory 174 via the system controller 172. The image memory 174 is not limited to being a memory composed of a semiconductor element, and may also use a magnetic medium, such as a hard disk.

The system controller 172 is constituted by a central processing unit (CPU) and peripheral circuits thereof, and the like, and functions as a control apparatus which controls the whole of the inkjet recording apparatus 110 in accordance with prescribed programs, as well as functioning as a calculation apparatus which carries out various calculations. In other words, the system controller 172 controls the various units, such as the communications interface 170, the image memory 174, the motor driver 176, the heater driver 178, and the like, and controls communications with the host computer 186 as well as controlling the reading and writing of data to the image memory 174 and the ROM 175, and furthermore, it also generates control signals for controlling the motor 188 of the conveyance system and the heater 189.

The ROM 175 stores programs which are executed by the CPU of the system controller 172 and various data required for control purposes (including data of the ejection waveform for image formation and the ejection waveform for dummy ejection), and the like. The ROM 175 may be a non-rewritable storage device, or it may be a writable storage device, such as and EEPROM. The ROM 175 according to the present embodiment is constituted by a rewritable EEPROM and also serves as a history information storage device which stores operating history information for each of the heads of the respective heads, and ejection history information for each nozzle.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. In FIG. 23, reference numeral 188 represents motors arranged in respective parts of the apparatus. The motor 188 includes the motor driving the pressure drum 112 illustrated in FIG. 16, the motor driving the paper feeding roller 130, and other motors.

The heater driver (drive circuit) 178 drives the heater 189 of the post-drying unit 142 or the like in accordance with commands from the system controller 172. In FIG. 23, reference numeral 189 represents heaters arranged in the inkjet recording apparatus 110. The heater 189 in FIG. 23 includes the heater of the solvent drying unit 120, the heater 136 of the fixing processing unit 122, the heater 94 functioning as a heating means for the anti-drying liquid illustrated in FIG. 22, and other heaters.

The print controller 180 has a signal processing function for performing various tasks, compensations, and other types of processing for generating print control signals from the image data (original image data) stored in the image memory 174 in accordance with control commands from the system controller 172 so as to supply the generated print data (dot data) to the head driver 184. In the print controller 180, required signal processing is performed, and the ejection volume and ejection timing of ink droplets of the head 150 are controlled via the head driver 184 on the basis of the image data. This control can realize a desired dot size and a desired dot arrangement.

The image buffer memory 182 is provided with the print controller 180, and image data, parameters, and other data are temporarily stored in the image buffer memory 182 when image data is processed in the print controller 180. FIG. 23 illustrates a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed is input from an external source via the communications interface 170, and is accumulated in the image memory 174. At this stage, RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using a threshold value matrix, error diffusion, or the like, in the print controller 180.

In other words, the print controller 180 performs processing for converting the input RGB image data into dot data for the four colors of K, C, M and Y. The dot data generated by the print controller 180 in this way is stored in the image buffer memory 182.

The head driver 184 outputs drive signals for driving the actuators 58 corresponding to the nozzles 151 of the head 150, on the basis of print data (in other words, dot data stored in the image buffer memory 182) supplied by the print controller 180. A feedback control system for maintaining constant drive conditions in the head may be included in the head driver 184.

By supplying the drive signals output by the head driver 184 to the print heads 150, ink is ejected from the corresponding nozzles 151. By controlling ink ejection from the print head 150 while controlling the conveyance speed of the recording medium 114 so as to be a prescribed speed, an image is formed on the recording medium 114.

Furthermore, the system controller 172 functions as a device which controls the negative pressure suctioning of the recording medium 114 by the pressure drum 112 in FIG. 16, and when the recording medium 114 is received onto the pressure drum 112, a command signal is sent to the suctioning apparatus so as to generate a negative pressure in the suction ports which are provided on the circumferential surface of the pressure drum 112.

Moreover, the system controller 172 also functions as a device which controls the nip pressure of the fixing process unit 122. When type information relating to a recording medium 114 is acquired, the system controller controls the clearance between the heating roller 138 of the fixing process unit 122 and the supporting roller 140 so as to achieve a nip pressure corresponding to the recording medium 114 that is being processed.

Furthermore, the system controller 172 sends command signals to the respective sections of the apparatus on the basis of determination signals obtained from the sensor 192. The sensor 192 in FIG. 23 includes a paper supply sensor which is provided in a receiving portion for recording media 114 of the pressure drum 112 in FIG. 16, a temperature sensor which determines the surface temperature of the pressure drum 112, a temperature sensor which is provided in the solvent drying unit 120, a temperature sensor which is provided in the fixing process unit 122, and a temperature sensor which is provided in order to control the heater 94 in FIG. 22, and the like.

Data of the image capture results for the recorded image is input to the print controller 180 in FIG. 23, from the print determination unit (in-line sensor) 194 which is disposed in the output unit 124 in FIG. 16. The print determination unit 194 has an image sensor for capturing the ink droplet deposition result by the print unit 118, and functions as a device to check for ejection abnormalities, such as blocking of nozzles from the droplet ejection image read in by the image sensor.

More specifically, the print determination unit 194 reads an image (test pattern) printed on the recording medium 114, determines the print conditions (presence of the ejection, variation in the dot formation, and the like) by performing required signal processing, or the like, and provides the determination results of the print conditions to the print controller 180.

The print controller 180 implements various corrections with respect to the head 150, on the basis of the information obtained from the print determination unit 194, according to requirements, and it implements control for carrying out cleaning operations (nozzle restoring operations), such as preliminary ejection, suctioning, or wiping, as and when necessary.

For example, whenever an ejection defect is detected in the head 150 by the print determination unit 194, then the print controller 180 implements control in such a manner that preliminary ejection is carried out automatically. Alternatively, it is possible to adopt a mode in which, whenever an ejection defect of the head 150 has been determined by the print determination unit 194, control is implemented in such a manner that preliminary ejection is carried out automatically only in the head (118C, 118M, 118Y and 118K) where the ejection defect has been determined, or only in the nozzle row or the particular nozzle which is suffering an ejection defect in that head.

Furthermore, the system controller 172 in FIG. 23 functions as a control device which controls the operation of the pressurization pump 32 provided in the anti-drying liquid supply section and the operation of the suction pump 34 provided in the discharge section, and the system controller 172 outputs control signals to the drive circuits 197, 198 of the respective pumps.

The system controller 172 drives the pressurization pump 32 and the suction pump 34 in such a manner that anti-drying liquid flows continuously over the nozzle surface during printing. Furthermore, the pressurization pump 32 and the suction pump 34 are also operated during printing standby, as necessary, so as to perform humidification.

In the embodiments described above, an inkjet recording apparatus using a method of forming an image by ejecting ink droplets directly onto a recording medium 114 (direct recording method) is described, but the range of application of the present invention is not limited to this, and it is also possible to apply the present invention to an image forming apparatus of an intermediate transfer type which once forms an image (primary image) on an intermediate transfer body and then transfers that image onto a recording paper in a transfer unit, thereby forming an image finally.

In the embodiments described above, an inkjet recording apparatus using a page-wide full line type head having a nozzle row of a length corresponding to the entire width of the recording medium is described (an image forming apparatus with a single-path system that finishes an image by one sub-scanning action), but the scope of application of the present invention is not limited to this, and the present invention may also be applied to an inkjet recording apparatus which performs image recording by means of a plurality of head scanning actions which move a short recording head, such as a serial head (shuttle scanning head), or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

APPENDIX

As has become evident from the detailed description of the embodiments of the present invention given above, the present specification includes disclosure of various technical ideas including the invention described below.

One aspect of the present invention is directed to a liquid ejection head comprising: a nozzle plate having a nozzle surface in which at least one nozzle for ejecting droplets of a liquid are formed; an anti-drying liquid supply port which supplies an anti-drying liquid to the nozzle surface of the nozzle plate; a flow channel portion which is formed in the nozzle surface and through which the anti-drying liquid supplied to the nozzle surface from the anti-drying liquid supply port flows; and an anti-drying liquid discharge port which suctions and discharges the anti-drying liquid flowing through the flow channel portion on the nozzle surface, from the nozzle surface, wherein, while the anti-drying liquid flows through the flow channel portion, the anti-drying liquid evaporates to increase humidity.

Desirably, the flow channel portion is a lyophilic region formed in the nozzle surface.

According to this aspect of the invention, the lyophilic region becomes the region where the anti-drying liquid flows on the nozzle surface, which can prevent the anti-drying liquid from flowing into the nozzle.

Desirably, the flow channel portion is a groove formed in the nozzle surface.

According to this aspect of the invention, the groove becomes the region where the anti-drying liquid flows on the nozzle surface, which can prevent the anti-drying liquid from flowing into the nozzle. In cases of the groove having lyophilic properties, the holding force of the liquid can be improved further.

Desirably, the nozzle surface is inclined with respect to a horizontal direction in such a manner that the anti-drying liquid flows downward on the nozzle surface in accordance with an inclination of the nozzle surface.

According to this aspect of the invention, the liquid smoothly flows without staying on the nozzle surface.

Desirably, the liquid ejection head further comprises: a supply channel forming member which includes the anti-drying liquid supply port and a supply channel connected to the anti-drying liquid supply port; and a discharge channel forming member which includes the anti-drying liquid discharge port and a discharge channel connected to the anti-drying liquid discharge port, wherein the supply channel forming member and the discharge channel forming member are situated across the nozzle plate.

According to this aspect of the invention, it is possible to easily provide the anti-drying liquid supply port and the anti-drying liquid discharge port even in cases of high density head.

Desirably, the liquid ejection head further comprises a suction pump which is connected to the anti-drying liquid discharge port for suctioning the anti-drying liquid on the nozzle surface.

By suctioning and discharging the anti-drying liquid forcibly with the suction pump, it is possible to promote the flow of the anti-drying liquid on the nozzle surface.

Desirably, the liquid ejection head further comprises a pressurization pump which is connected to the anti-drying liquid supply port for sending the anti-drying liquid onto the nozzle surface.

In supplying the anti-drying liquid, it is desirable to adjust the pressurization so that the anti-drying liquid may not drip from the nozzle surface.

Another aspect of the present invention is directed to an image forming apparatus comprising one of the above-described liquid ejection heads.

According to image forming apparatus of embodiments of the present invention, nozzle blockages are prevented and stable image formation is possible.

The inkjet recording apparatus which is one mode of the image forming apparatus of the present invention comprises: a liquid ejection head (recording head) in which a plurality of liquid droplet ejection elements (ink liquid chamber units) are arranged at high density, each liquid droplet ejection element comprising a nozzle (ejection port) for ejecting an ink droplet in order to form a dot and a pressure generating device (piezoelectric element or heating element for heating and bubble generation) which generates an ejection pressure; and an ejection control device which controls the ejection of liquid droplets from the liquid ejection head on the basis of ink ejection data (dot image data) generated from the input image. An image is formed on a recording medium by means of the liquid droplets ejected from the nozzles.

For example, color conversion and halftone processing are carried out on the basis of the image data (print data) input via the image input device, and ink ejection data corresponding to the ink colors is generated. The driving of the pressure generating elements corresponding to the respective nozzles of the liquid ejection head is controlled on the basis of this ink ejection data, and ink droplets are ejected from the nozzles.

In order to achieve high-resolution image output, a desirable mode is one using a recording head in which a large number of liquid droplet ejection elements (ink chamber units) are arranged at high density, each liquid droplet ejection element comprising a nozzle (ejection port) which ejects ink liquid, a pressure chamber corresponding to the nozzle, and a pressure generating device.

A compositional example of a recording head based on an inkjet method of this kind is a full line type head having a nozzle row in which a plurality of ejection ports (nozzles) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the relative feed direction (relative conveyance direction) of a recording medium, but a mode may also be adopted in which the head is disposed following an oblique direction that forms a prescribed angle with respect to the direction perpendicular to the conveyance direction.

The "recording medium" is a medium receiving an ink deposition ejected from an ejection opening of a recording head (which may also be called a print medium, an image forming medium, a recording medium, an image receiving medium, or an ejection receiving medium, or the like. There are no particular restrictions on the shape or material of the recording medium, which may be various types of media, irrespective of material and size, such as sheet paper (cut paper), sealed paper, continuous paper, resin sheets such as OHP sheets, film, cloth, a printed circuit substrate on which a wiring pattern, or the like, is formed, a rubber sheet, an intermediate transfer medium, a metal sheet, or the like.

The conveyance device for causing a recording medium and a recording head to move relative to each other may include a mode where the recording medium is conveyed with respect to a stationary (fixed) head, or a mode where a head is moved with respect to a stationary recording medium, or a mode where both the head and the recording medium are moved. When forming color images by means of an inkjet print head, it is possible to provide print heads for the respective colors of a plurality of colored inks (recording liquids), or it is possible to eject inks of a plurality of colors, from one recording head.

Desirably, the liquid ejected from the at least one nozzle is an ink composition containing pigment; and the anti-drying liquid is a liquid containing a solvent having a solubility parameter of 27.5 or less, the solvent being 50 percent by mass of an entire solvent.

According to this aspect of the invention, the anti-drying liquid also serves as a cleaning liquid, and therefore a special cleaning liquid is not required.

Desirably, a portion other than the flow channel portion of the nozzle surface has a liquid repellent property.

Desirably, the anti-drying liquid supply port and the anti-drying liquid discharge port are formed in the nozzle plate.

Desirably, the flow channel portion has a meandering shape in the nozzle surface.

Desirably, the flow channel portion is formed in a direction of a long side of the nozzle plate.

Desirably, the flow channel portion is formed in a direction of a short side of the nozzle plate.

Desirably, the flow channel portion includes a plurality of flow channels which are connected to the anti-drying liquid supply port.

Desirably, the flow channel portion includes a plurality of flow channels which are connected to the anti-drying liquid discharge port.

Desirably, a nozzle row formed by the nozzles are formed in the nozzle surface, and the flow channel portion is formed along the nozzle row.

Desirably, the flow channel portion has a cross section having an inverted trapezoidal shape.

Desirably, the anti-drying liquid has a higher temperature than the nozzle plate.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head comprising:

a nozzle plate having a nozzle surface in which at least one nozzle for ejecting droplets of a liquid are formed;

an anti-drying liquid supply port which supplies an anti-drying liquid to the nozzle surface of the nozzle plate;

a flow channel portion which is formed in the nozzle surface and through which the anti-drying liquid supplied to the nozzle surface from the anti-drying liquid supply port flows; and an anti-drying liquid discharge port which suctions and discharges the anti-drying liquid flowing through the flow channel portion on the nozzle surface, from the nozzle surface, wherein, while the anti-drying liquid flows through the flow channel portion, the anti-drying liquid evaporates to increase humidity.

2. The liquid ejection head as defined in claim 1, wherein the flow channel portion is a lyophilic region formed in the nozzle surface.

3. The liquid ejection head as defined in claim 2, wherein a portion other than the flow channel portion of the nozzle surface has a liquid repellent property.

4. The liquid ejection head as defined in claim 1, wherein the flow channel portion is a groove formed in the nozzle surface.

5. The liquid ejection head as defined in claim 4, wherein the flow channel portion has a cross section having an inverted trapezoidal shape.

6. The liquid ejection head as defined in claim 1, wherein the nozzle surface is inclined with respect to a horizontal direction in such a manner that the anti-drying liquid flows downward on the nozzle surface in accordance with an inclination of the nozzle surface.

7. The liquid ejection head as defined in claim 1, further comprising:

a supply channel forming member which includes the anti-drying liquid supply port and a supply channel connected to the anti-drying liquid supply port; and a discharge channel forming member which includes the anti-drying liquid discharge port and a discharge channel connected to the anti-drying liquid discharge port, wherein the supply channel forming member and the discharge channel forming member are situated on opposite sides of the nozzle plate.

8. The liquid ejection head as defined in claim 1, further comprising a suction pump which is connected to the anti-drying liquid discharge port for suctioning the anti-drying liquid on the nozzle surface.

9. The liquid ejection head as defined in claim 1, further comprising a pressurization pump which is connected to the anti-drying liquid supply port for sending the anti-drying liquid onto the nozzle surface.

10. The liquid ejection head as defined in claim 1, wherein the anti-drying liquid supply port and the anti-drying liquid discharge port are formed in the nozzle plate.

11. The liquid ejection head as defined in claim 1, wherein the flow channel portion has a meandering shape in the nozzle surface.

12. The liquid ejection head as defined in claim 1, wherein the flow channel portion includes a plurality of flow channels which are connected to the anti-drying liquid supply port.

13. The liquid ejection head as defined in claim 1, wherein the flow channel portion includes a plurality of flow channels which are connected to the anti-drying liquid discharge port.

14. The liquid ejection head as defined in claim 1, wherein a nozzle row formed by the nozzles are formed in the nozzle surface, and the flow channel portion is formed along the nozzle row.

15. The liquid ejection head as defined in claim 1, wherein the anti-drying liquid has a higher temperature than the nozzle plate.

16. An image forming apparatus comprising the liquid ejection head as defined in claim 1.

17. The image forming apparatus as defined in claim 16, wherein:

the liquid ejected from the at least one nozzle is an ink composition containing pigment; and the anti-drying liquid is a liquid containing a solvent having a solubility parameter of 27.5 or less, the solvent being 50 percent by mass of an entire solvent.

* * * * *